US010870896B2

(12) United States Patent
Reiners et al.

(10) Patent No.: US 10,870,896 B2
(45) Date of Patent: Dec. 22, 2020

(54) SOLID, PARTICULATE TANNING AGENT PREPARATIONS

(75) Inventors: Juergen Reiners, Leverkusen (DE); Christopher Tysoe, Leverkusen (DE); Holger Luetjens, Cologne (DE); Rafael Grosch, Leverkusen (DE); Franz Heinzelmann, Leverkusen (DE); Christopher Henzel, Leverkusen (DE)

(73) Assignee: LANXESS Deutschland GmbH, Cologne (DE)

( * ) Notice: Subject to any disclaimer, the term of this patent is extended or adjusted under 35 U.S.C. 154(b) by 443 days.

(21) Appl. No.: 14/009,646

(22) PCT Filed: Mar. 29, 2012

(86) PCT No.: PCT/EP2012/055664
§ 371 (c)(1),
(2), (4) Date: Jan. 24, 2014

(87) PCT Pub. No.: WO2012/136565
PCT Pub. Date: Oct. 11, 2012

(65) Prior Publication Data

US 2014/0123399 A1 May 8, 2014

(30) Foreign Application Priority Data

Apr. 4, 2011 (EP) ..... 11161059

(51) Int. Cl.
*C14C 3/08* (2006.01)
*C14C 3/20* (2006.01)
*C14C 3/28* (2006.01)

(52) U.S. Cl.
CPC ..... *C14C 3/08* (2013.01); *C14C 3/20* (2013.01); *C14C 3/28* (2013.01)

(58) Field of Classification Search
CPC ..... C14C 3/00; C14C 3/20; C14C 3/28
USPC ..... 8/94.19 R, 436, 437; 428/473
See application file for complete search history.

(56) References Cited

U.S. PATENT DOCUMENTS

| | | | | |
|---|---|---|---|---|
| 2,923,594 A | | 2/1960 | Lieberman et al. | |
| 3,976,622 A | | 8/1976 | Wagner et al. | |
| 4,413,997 A | * | 11/1983 | Milligan | C14C 3/28 8/94.21 |
| 4,837,359 A | | 6/1989 | Woynar et al. | |
| 4,904,750 A | | 2/1990 | Reiners et al. | |
| 4,960,848 A | | 10/1990 | Scholl et al. | |
| 4,994,541 A | | 2/1991 | Dell et al. | |
| 5,076,958 A | | 12/1991 | Pedain et al. | |
| 5,138,046 A | | 8/1992 | Bluest et al. | |
| 5,576,425 A | | 11/1996 | Hill et al. | |
| 5,618,317 A | * | 4/1997 | Traubel | C14C 3/18 424/59 |
| 5,820,634 A | * | 10/1998 | Traubel | C14C 3/28 8/94.18 |
| 5,885,474 A | | 3/1999 | Reiners et al. | |
| 5,888,400 A | | 3/1999 | Tholema et al. | |
| 6,156,885 A | | 12/2000 | Meroni et al. | |
| 6,254,644 B1 | * | 7/2001 | Traubel | C08G 18/8083 428/473 |
| 2006/0080784 A1 | * | 4/2006 | Ebbinghaus | C08G 18/0828 8/94.33 |
| 2012/0208959 A1 | * | 8/2012 | Mueller | C08G 61/08 524/836 |

FOREIGN PATENT DOCUMENTS

| | | | | | |
|---|---|---|---|---|---|
| DE | 848823 | A | | 9/1952 | |
| DE | 102006056479 | A1 | | 5/2008 | |
| GB | 1145952 | | | 3/1969 | |
| JP | 10060499 | A | * | 3/1998 | C14C 3/18 |
| WO | WO009814425 | A1 | * | 4/1998 | |
| WO | WO-2010130311 | A1 | * | 11/2010 | C14C 3/26 |
| WO | WO-2011051374 | A1 | * | 5/2011 | C08G 61/08 |
| WO | WO-2012016907 | A1 | * | 2/2012 | C14C 3/20 |

OTHER PUBLICATIONS

Google Patents translation of JP10060490A pp. 1-8 Mar. 3, 1998.*
European Search Report from European Application No. 11161059, dated Dec. 2, 2011, 2 pages.

* cited by examiner

*Primary Examiner* — Vasudevan S Jagannathan
*Assistant Examiner* — Preeti Kumar
(74) *Attorney, Agent, or Firm* — Nicanor A. Kohncke; Christopher L. McDavid

(57) ABSTRACT

Solid particulate material containing a) at least one compound containing carbamoylsulphonate groups and b) at least one organic tanning agent.

17 Claims, No Drawings

SOLID, PARTICULATE TANNING AGENT PREPARATIONS

The invention relates to a solid particulate material containing at least one compound containing carbamoylsulphonate groups and at least one organic tanning agent, a method of making and use of the solid particulate material as pretanning agent, tanning agent or returning agent.

Isocyanates and their use as tanning agents are known in principle and are described for example in U.S. Pat. No. 2,923,594 "method of tanning", U.S. Pat. No. 4,413,997 "dicarbamoylsulfonate tanning agent" or H. Träubel, Tannings with Isocyanates [in German], parts 1 and 2, Das Leder, 1977, pages 150 ff and 181 ff. It transpires that only isocyanates of relatively low molecular weight are effective in crosslinking the collagen molecules and hence in raising the shrinkage temperature of leather.

Yet these compounds have toxicological properties, a high vapour pressure and low solubility in water and so cannot be used in customary tanning apparatus. In addition, isocyanates in aqueous solution are quick to react, via the intermediate stages of carbamic acid and amine, to form a polymeric urea which has no tanning effect whatsoever. Therefore, temporary blocking of the isocyanate function with a protective group is advisable.

EP-A 0 690 135 and EP-A 0 814 168 describe modified isocyanates to reduce these problems. Selected isocyanates are first reacted with a polyether alcohol and then converted with bisulphite to the carbamoyl compound which is substantially inert to the reaction with water. An aqueous dispersion is obtained with sufficient stability for use in the tanning operation. However, this process has two serious disadvantages:

- The reaction of isocyanate with polyether alcohol has to be carried out in the absence of water and preferably without viscosity-depressing solvents and therefore requires costly hi-tech hardware and also an additional step of synthesis.
- The reaction of the polyether alcohol with the isocyanate consumes some of the isocyanate functions and thus reduces the tanning performance of the product.

EP-A-1647563 discloses aqueous compositions containing at least one compound containing carbamoylsulphonate groups and at least one alcohol alkoxylate.

The alcohol alkoxylates described therein are alkoxylated long-chain or branched alcohols. More particularly, branched ethoxylates of fatty alcohol are preferred for use as emulsifiers. However, the solutions obtained tend to undergo a phase separation at elevated ambient temperature, for example at 30-40° C., which is not reversible on cooling down. Using the products after some period of storage therefore necessitates a homogenization necessitating additional expense and particular care in commercial practice. Performance as a tanning agent is therefore adversely affected under unfavourable conditions of storage.

Compounds containing carbamoylsulphonate groups are hydrolysis sensitive in the presence of liquid tanning agent relations, which can lead to a loss of efficacy. It is accordingly very difficult to obtain sufficiently storage-stable formulations of compounds containing carbamoylsulphonate groups.

Furthermore, the fact that compounds containing carbamoylsulphonate groups are sensitive in aqueous solution and become increasingly sensitive in the aqueous solution with increasing temperature argues against producing solid formulations using the customary industrial processes such as spray drying, since high temperatures are required here to evaporate the water. The continuing problem was therefore that of providing stable and easily accessible and also easily meterable tanning agent formulations which do not have the disadvantages mentioned. Moreover, these formulations also have to be very durable at elevated storage temperatures (e.g. 30° C. to 60° C.).

WO 98/14425 discloses an emulsifier-free method of producing bisulphite adducts of aliphatic isocyanates comprising aromatic units. This method utilizes an organic solvent, preferably a substituted pyrrolidone such as NMP and a co-solvent for example triethanolamine but no emulsifier. The method utilizes tin-containing compounds as catalysts. Yet this method is disadvantageous because of its low yield.

The problem is surprisingly solved by a solid particulate material containing a) at least one compound containing carbamoylsulphonate groups and b) at least one organic tanning agent.

The material according to the invention preferably has a melting point of above 20° C., more preferably of above 60° C. and especially above 100° C.

By "particulate" is more particularly a material having an average particle size of 0.1 μm to 1000 μm, preferably 1 to 800 μm and especially 50 to 300 μm, the average being the weight average of all particles. Other averages (volume averages) can be computed therefrom via analytical methods, and vice versa. Average particle size can be determined microscopically for example. The solid material is preferably in the form of powder or granulate.

The particulate solid material according to the invention preferably has a residual moisture content of 0 to 10 wt%, especially 0 to 5 wt% and more preferably 0 to 2 wt%, based on the material. The particulate solid material according to the invention is based on any desired structure of particle, preferably one which is ball shaped or ball shaped like or derived therefrom. Agglomerates of particles from the recited shapes in the range of the specified particle size are also possible. According to the invention, the material may be in the form of powder, granulate or so-called microgranulate as obtained in single-substance nozzle spray drying for example.

Component a)

Compounds containing carbamoylsulphonate groups are compounds incorporating the following structural unit:

$$—NH—CO—SO_3^-K^+$$

where $K^+$ is a cation equivalent.

Component a) compounds containing carbamoylsulphonate groups are preferably reaction products formed from at least one organic polyisocyanate and at least one bisulphite and/or disulphite.

Suitable organic polyisocyanates include especially aliphatic, cycloaliphatic, araliphatic, aromatic or heterocyclic polyisocyanates, as described by W. Siefken Liebigs Annalen der Chemie 562, pages 75 to 136, for example.

Preference is given to organic polyisocyanates having an NCO functionality of 1.8 to 4.2 with a molar mass of preferably below 800 g/mol, especially organic polyisocyanates having an NCO functionality of 1.8 to 2.5 and a molar mass below 400 g/mol.

Preferred polyisocyanates are compounds of formula $Q(NCO)_n$ with an average molecular weight below 800, where n is at least 1.8, preferably from 1.8 to 4.2, Q is an aliphatic $C_2$-$C_{12}$-hydrocarbon radical, in particular $C_4$-$C_{12}$-hydrocarbon radical, a cycloaliphatic $C_6$-$C_{15}$-hydrocarbon radical or a heterocyclic $C_2$-$C_{12}$ radical having 1 to 3 heteroatoms from the series oxygen, sulphur, nitrogen, for example (i) diisocyanates such as ethylene diisocyanate, 1,2-propylene diisocyanate, 1,3-propylene diisocyanate, 1,4-tetramethylene diisocyanate, 1,5-pentamethylene diisocyanate, 1,6-hexamethylene diisocyanate, 1,12-dodecane diisocyanate, 2-isocyanatomethyl-1,8-octamethylene diisocyanate, 1,3-diisocyanatocyclobutane, 1-isocyanato-2-isocyanatomethylcyclopentane, 1,3- and 1,4-diisocyanatocyclohexane and also any desired mixtures of these isomers, 1,2-, 1,3- and 1,4-bis(isocyanatomethyl)cyclohexane and also any desired mixtures of these isomers, 1,2-, 1,3- and 1,4bis(isocyanatoethyl)cyclohexane and also any desired mixtures of these isomers, 1,2-, 1,3- and 1,4bis(isocyanato-n-propyl)cyclohexane and also any desired mixtures of these isomers, 1-isocyanatopropyl-4-isocyanatomethylcyclohexane and isomers, 1-isocyanato-3,3,5-trimethyl-5-isocyanatomethylcyclohexane, 2,4- and 2,6-hexahydrotolylene diisocyanate and also any desired mixtures of these isomers, 2,4'- and 4,4'-diisocyanatodicyclohexylmethane and isomers, 1,3- and 1,4-phenylene diisocyanate, 2,4- and 2,6-tolylene diisocyanate and also any desired mixtures of these isomers, diphenylmethane 2,4'- and/or 4,4'-diisocyanate, naphthalene 1,5-diisocyanate, polyisocyanates containing uretdione groups such as, for example, the bis(6-isocyanatohexyl)-uretdione or the 1-isocyanato-3,3,5-trimethyl-5-isocyanatomethylcyclohexane dimer containing the uretdione structure and any desired mixtures of the aforementioned polyisocyanates; (ii) trifunctional and higher polyisocyanates such as the isomers of the triisocyanatotriphenylmethane series (such as triphenylmethane 4,4',4"-triisocyanate) and their mixtures; (iii) compounds prepared by allophanatization, trimerization or biuretization of the polyisocyanates (i) and/or (ii) and having at least 2.7 isocyanate groups per molecule. Examples of polyisocyanates prepared by trimerization are the 1-isocyanato-3,3,5-trimethyl-5-isocyanatomethylcyclohexane trimer obtainable by isocyanurate formation and the polyisocyanates containing isocyanurate groups and obtainable by trimerization of hexamethylene diisocyanate, optionally mixed with 2,4'-diisocyanatotoluene. Examples of polyisocyanates prepared by biuretization are tris(isocyanatohexyl)-biuret and its mixtures with its higher homologues, obtainable as described in German laid-open specification DOS 23 08 015 for example. Diisocyanates are particularly preferred.

Particularly preferred polyisocyanates are those having a molecular weight of less than 400 g/mol with NCO groups attached to aliphatics or cycloaliphatics, for example 1,4-diisocyanatobutane, 1,6-diisocyanatohexane (HDI), 1,5-diisocyanato-2,2-dimethylpentane, 2,2,4- or 2,4,4-trimethyl-1,6-diisocyanatohexane (TMHI), 1,3- and 1,4-diisocyanatohexane, 1,3- and 1,4-diisocyanatocyclohexane (CHDI) and also any desired mixtures of these isomers, 1-isocyanato-2-isocyanatomethylcyclopentane, 1,2-, 1,3- and 1,4-bis(isocyanatomethyl)cyclohexane and also any desired mixtures of isomers, 1,2-, 1,3- and 1,4-bis(isocyanatoethyl)cyclohexane and also any desired mixtures of these isomers, 1,2-, 1,3- and 1,4-bis(isocyanato-n-propyl) cyclohexane and also any desired mixtures of these isomers, 1-isocyanatopropyl-4-isocyanatomethylcyclohexane and isomers, 1-isocyanato-3,3,5-trimethyl-5-isocyanatomethylcyclohexane (IPDI), 1-isocyanato-1-methyl-4-isocyanatomethylcyclohexane (IMCI), 2,4'- and 4,4'-diisocyanatodicyclohexylmethane ($H_{12}$MDI) and isomers, dimeryl diisocyanate (DDI), bis(isocyanatomethyl)bicyclo[2.2.1] heptane (NBDI), bis(isocyanatomethyl)tricyclo[5.2.1.$0^{2,6}$] decane (TCDDI) and isomers and any desired mixtures of such diisocyanates. Also araliphatic polyisocyanates such as the xylylene diisocyanates of the formulae

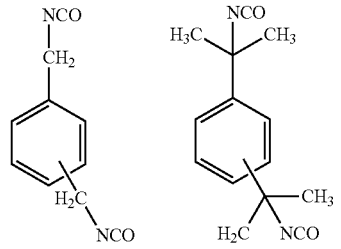

can be used.

The use of the above diisocyanates is preferred. However, it is also possible to use monofunctional aliphatic isocyanates such as, for example, butyl isocyanate, hexyl isocyanate, cyclohexyl isocyanate, stearyl isocyanate or dodecyl isocyanate and/or polyisocyanates having an average NCO functionality of 2.2 to 4.2.

The higher-functional polyisocyanates are preferably polyisocyanate mixtures consisting essentially of trimeric 1,6-diisocyanatohexane, trimeric 1,2-, 1,3- or 1,4-bis(isocyanatomethyl)-cyclohexane, trimeric 1,2-, 1,3- or 1,4-bis (isocyanatoethyl)cyclohexane, trimeric 1,2-, 1,3- or 1,4-bis (isocyanato-n-propyl)cyclohexane, trimeric 1-isocyanatopropyl-4-isocyanatomethylcyclohexane and isomers, or trimeric 1-isocyanato-3,3,5-trimethyl-5-isocyanatomethylcyclohexane and optionally dimeric 1,6-diisocyanatohexane, dimeric 1,2-, 1,3- or 1,4-bis(isocyanatomethyl)-cyclohexane, dimeric 1,2-, 1,3- or 1,4-bis (isocyanatoethyl)cyclohexane, dimeric 1,2-, 1,3- or 1,4-bis (isocyanato-n-propyl)cyclohexane, dimeric 1-isocyanatopropyl-4-isocyanatomethylcyclohexane and isomers, or dimeric 1-isocyanato-3,3,5-trimethyl-5-isocyanatomethylcyclohexane and the correspondingly higher homologues, including isocyanurate groups and optionally uretdione groups and having an NCO content of 19 to 24 wt%, as obtained by conventional catalytic trimerization and by isocyanurate formation of 1,6-diisocyanatohexane, 1,2-, 1,3- or 1,4-bis(isocyanatomethyl)cyclohexane, 1,2-, 1,3- or 1,4-bis(isocyanatoethyl)cyclohexane, 1,2-, 1,3- or 1,4-bis (isocyanato-n-propyl)cyclohexane, 1-isocyanatopropyl-4-isocyanatomethylcyclohexane and isomers, or of 1-isocyanato-3,3,5-trimethyl-5-isocyanatomethylcyclohexane and preferably having an (average) NCO functionality of 3.2 to 4.2.

Further suitable polyisocyanates are polyisocyanates of uretdione and/or isocyanurate, urethane and/or allophanate, biuret or oxadiazine structure which are prepared by modification of aliphatic or cycloaliphatic diisocyanates, as described by way of example in DE-A 1 670 666, DE-A 3 700 209 and DE-A 3 900 053 and EP-A 336 205 and EP-A 339 396 for example. Suitable polyisocyanates are also, for example, the polyisocyanates which contain ester groups, for example the tetrakis- or triisocyanates obtainable by reaction of pentaerythritol or trimethylolpropane silyl ethers with isocyanatocaproyl chloride (cf. DE-A 3 743 782). It is also possible to use triisocyanates such as trisisocyanatodicyclohexylmethane for example.

The use of monofunctional and of more than difunctional isocyanates is preferably restricted in both cases to amounts of, in each case, not more than 10 mol %, based on total polyisocyanates.

However, the abovementioned aliphatic, cycloaliphatic and araliphatic diisocyanates are very particularly preferred. Particular preference is given to hexamethylene diisocyanate (HDI), diisocyanatocyclohexane, 1,2-, 1,3- and 1,4-bis(isocyanatomethyl)cyclohexane and also any desired mixtures of isomers, 1,2-, 1,3- and 1,4-bis(isocyanatoethyl)cyclohexane and also any desired mixtures of these isomers, 1,2-, 1,3- and 1,4-bis(isocyanato-n-propyl)cyclohexane and also any desired mixtures of these isomers, 2,4'- and 4,4'-diisocyanatodicyclohexylmethane, 1-isocyanatopropyl-4-isocyanatomethylcyclohexane and isomers and 1-isocyanato-3,3,5-trimethyl-5-isocyanatomethylcyclohexane (IPDI). From this last-mentioned group it is hexamethylene diisocyanate (HDI), 1,2-, 1,3- and 1,4-bis(isocyanatomethyl)cyclohexane and also mixtures of these isomers which are specifically preferable.

Bisulphites and/or disulphites are preferably their alkali metal or ammonium salts, especially the sodium salts of sulphurous or, respectively, disulphurous acid, i.e. sodium hydrogensulphite ($NaHSO_3$) and sodium disulphite ($Na_2S_2O_5$), respectively.

It is also advantageous to use the other alkali metal and ammonium salts of these acids, viz. potassium bisulphite, potassium disulphite, lithium bisulphite, lithium disulphite, ammonium bisulphite, ammonium disulphite and also simple tetraalkylammonium salts of these acids, for example tetramethylammonium bisulphite, tetraethylammonium bisulphite, and so on. For blocking, the salts are preferably used in the form of aqueous solutions having solids contents of 5 to 40 wt%.

In a preferred embodiment of the invention, the compounds containing carbamoyl groups are based on aliphatic polyisocyanates such as hexamethylene diisocyanate, isophorone diisocyanate, bis(isocyanato)cyclohexane, 1,2-, 1,3- and 1,4-bis(isocyanatomethyl)cyclohexane and also any desired mixtures of isomers, 1,2-, 1,3- and 1,4-bis(isocyanatoethyl)cyclohexane and also any desired mixtures of these isomers, 1,2-, 1,3- and 1,4-bis(isocyanato-n-propyl)cyclohexane and also any desired mixtures of these isomers, 1-isocyanatopropyl-4-isocyanatomethylcyclohexane and isomers, 2,4'- and 4,4'-diisocyanatodicyclohexylmethane or nonyl triisocyanate and also mixtures thereof, but especially hexamethylene diisocyanate, 1,2-, 1,3- and 1,4-bis(isocyanatomethyl)-cyclohexane and also any desired mixtures of isomers, 1,2-, 1,3- and 1,4-bis(isocyanatoethyl)-cyclohexane and also any desired mixtures of these isomers, 1,2-, 1,3- and 1,4-bis(isocyanato-n-propyl)cyclohexane and also any desired mixtures of these isomers and/or isophorone diisocyanate, more preferably hexamethylene diisocyanate, isophorone diisocyanate, 1,3-bis(isocyanatomethyl)cyclohexane and 2,4'- and 4,4'-diisocyanatodicyclohexylmethane. From this last-mentioned group, it is on hexamethylene diisocyanate (HDI), 1,2-, 1,3- and 1,4-bis(isocyanatomethyl)cyclohexane and also mixtures of these isomers that the compounds containing carbamoyl groups rest with specific preference.

Component b)

Preferred organic tanning agents of component b) include syntans, resin tanning agents, polymeric retanning agents and also vegetable tanning agents.

The syntans comprise for example at least one condensation product based on

A) sulphonated aromatics,

B) aldehydes and/or ketones and optionally

C) one or more compounds selected from the group of aromatics which are not sulphonated, urea and urea derivatives.

"Based on" is to be understood as meaning that the condensation product was optionally prepared from further reactants besides A, B and optionally C. However, in the context of this application, the condensation products are preferably only prepared from A, B and optionally C.

Sulphonated aromatics in the context of this application also include sulphomethylated aromatics. Preferred sulphonated aromatics are: naphthalenesulphonie acids, phenolsulphonic acid, sulphonated ditolyl ether, 4,4'-dihydroxydiphenyl sulphone, sulphonated diphenylmethane, sulphonated biphenyl, sulphonated terphenyl or benzenesulphonic acids.

Useful aldehydes and/or ketones include especially aliphatic, cycloaliphatic and also aromatic ones. Preference is given to aliphatic aldehydes, of which more preferably, formaldehyde as well as other aliphatic aldehydes having 3 to 5 carbon atoms are useful.

Useful non-sulphonated aromatics include for example phenol, kresol or dihydroxydiphenylmethane.

Useful urea derivatives include for example dimethylolurea, melamine, dicyandiamide or guanidine.

Phenol and phenol derivatives such as for example phenolsulphonic acid are frequently also linked by a simultaneous action of formaldehyde and urea or by dimethylolurea (DE-A 1 113 457). Sulphonation products of aromatic compounds are generally (according to Ullmanns Encyklopaedie der technischen Chemie Volume 16 (4th edition) Weinheim 1979, p. 138) condensed with formaldehyde alone or together with further starting compounds without removal of unconverted starting compounds. A solubilising group in the case of phenols can also be introduced by sulphomethylating under simultaneous action of alkali metal hydrogensulphite and formaldehyde, together with the condensation. This sulphomethylation is described in DE-A 848 823 for example.

Further preferred condensation products are condensates of ditolyl ether sulphonic acid with 4,4'-dihydroxydiphenyl sulphone, phenolsulphonic acid with phenol, formaldehyde and urea.

Particularly preferred condensation products are obtained by condensation of sulphonated and optionally non-sulphonated aromatics with aliphatic aldehydes, preferably formaldehyde, although the meaning of sulphonated aromatics comprehends more particularly no sulphomethylated aromatics.

Such condensation products are preferably obtained by condensation of sulphonated naphthalene and sulphonated phenol or 4,4'-dihydroxydiphenyl sulphone with formaldehyde or by condensation of naphthalenesulphonic acid and formaldehyde or by condensation of sulphonated ditolyl ether, sulphonated phenol with formaldehyde or by condensation of sulphonated phenol, urea, phenol with formaldehyde or by condensation of sulphonated phenol, urea, phenol, sulphonated ditolyl ether with formaldehyde.

The condensation product preferentially obtained in the condensation preferably has an average degree of condensation in the range from 1 to 150, preferably in the range from 1 to 20 and especially from 1 to 5.

Preference is here given to products based on the condensation of naphthalenesulphonic acids, ditolyl ether sulphonic acids, phenolsulphonic acids, dihydroxydiphenyl sulphone and phenol and also combinations of these raw materials with formaldehyde or glutaraldehyde and optionally urea or urea derivatives.

Similarly suitable organic tanning agents are polycondensates based on dihydroxydiphenyl sulphone/naphthalenesulphonic acid and formaldehyde, dihydroxydiphenyl sulphone/ditolyl ether sulphonic acid and formaldehyde, dihydroxydiphenyl sulphone/phenolsulphonic acid/ditolyl ether sulphonic acid/urea and formaldehyde, sulphomethylated dihydroxydiphenyl sulphone/urea and aldehydes, preferably formaldehyde, and also sulphomethylated dihydroxydiphenyl sulphone/phenol/urea or urea derivatives and aldehydes, preferably formaldehyde, and also mixtures thereof (commercially available tanning agents such as, for example, TANIGAN® BN, TANIGAN® PR, TANIGAN® 3LN, TANIGAN® HO, TANIGAN® UW from Lanxess or mixtures thereof).

The organic tanning agents used, especially the syntans can additionally contain further additions such as buffers or ligninsulphonates.

Resin tanning agents likewise come into consideration as synthetic tanning agents, and are preferably polycondensates based on melamine, dicyandiamide, urea, ligninsulphonate or mixtures thereof with formaldehyde or glutaraldehyde.

The polymeric retanning agents preferred for use are high molecular weight water-soluble or water-dispersible products e.g. from the (co)polymerization reaction of unsaturated acids and derivatives thereof with, for example, filling or fatliquoring action on leather. Preference is given to (co) polymerization products of acrylic and methacrylic acids and also esters thereof.

Further polymeric retanning agents are the polyaspartamides described in WO 97/06279, with a number average molecular weight of 700 to 30,000, preferably 1300 to 16,000, obtainable by reaction of A. polysuccinimide having a number average molecular weight of 500 to 10000, preferably 500 to 6000 and especially 1000 to 4000, with B. 5 to 90, preferably 20 to 80 mol %, based on succinimide units of polysuccinimide A, of primary and/or secondary amine, the nitrogen substituents of which contain 1 to 60, preferably 1 to 36 carbon atoms and may be substituted by fluorine atoms, hydroxyl groups, amino groups and/or organosilicon moieties and/or interrupted by oxygen atoms, ester groups, amide groups, urea groups or urethane groups, wherein at least 2.5, preferably at least 15 and especially at least 30 mol % of the nitrogen substituents of the amine contain at least 12 carbon atoms, optionally C. (i) derivatives of $C_1$-$C_{18}$-monocarboxylic acids and/or $C_2$-$C_{10}$-dicarboxylic acids and/or (ii) monoisocyanates, diisocyanates or epichlorohydrin (to react amino and/or hydroxyl groups on the nitrogen substituents of the reaction product of A and B), and (mandatorily)

D. 95 to 10, preferably 80 to 20 mol % of ring-opening base in the presence of water.

Hereby the preferred polyaspartamides of WO 97/06279 should also be deemed incorporated herein.

Further polymeric retanning agents are for example (co) polymers which contain a) structural units of the general formula I (I)

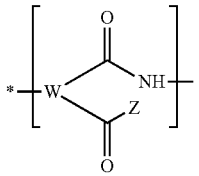

where

W represents a trivalent moiety from the group

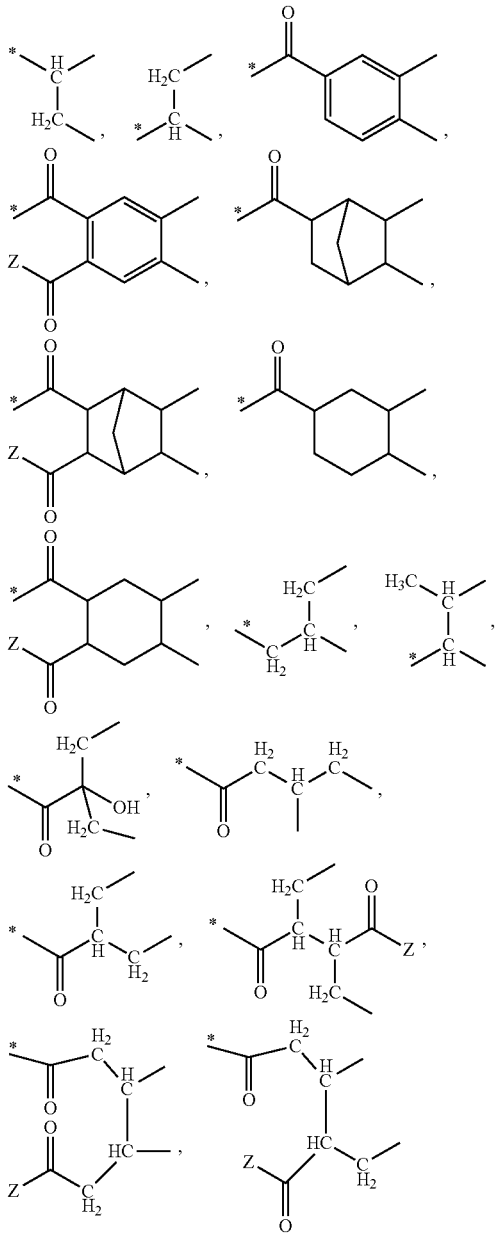

where

* indicates the orientation for incorporating the W moiety in formula I, and

Z represents the moieties —OH, —$O^-M^+$ or —N—$R^1R^2$, where $R^1$ and $R^2$ each independently represent hydrogen, optionally substituted alkyl moieties, alkenyl moieties, aralkyl moieties or cycloalkyl moieties which may be interrupted by oxygen atoms, nitrogen atoms, silicon atoms or amide, carbonate, urethane, urea, allophanate, biuret isocyanurate groups or mixtures thereof, and $M^+$ represents $H^+$ or an alkali metal ion, an $NH_4$ ion or a primary, secondary, tertiary or quaternary aliphatic ammonium moiety which preferably bears a $C_1$-$C_{22}$-alkyl or -hydroxyalkyl group, b) at least 10 mol %, based on the units of formula I, of structural units of the general formula Ia (Ia)

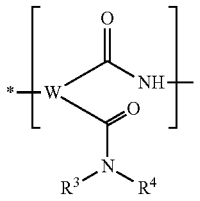

where $R^3$ represents a hydrocarbon moiety with $C_1$-$C_{60}$ atoms, preferably a saturated $C_1$-$C_{60}$-alkyl moiety, especially $C_8$-$C_{30}$-alkyl moiety, and $R^4$ represents hydrogen or has the same meaning as $R^3$, and c) polyether units having an average molecular weight of 200-6000 g/mol.

Vegetable tanning agents are, for example, tanning agents obtained from vegetable sources and belonging to the classes of condensed tanning agents or hydrolysable tanning agents e.g. chestnut extract, mimosa, tara or quebracho. Vegetable tanning agents also include those obtainable from vegetable sources such as algae, fruit, e.g. rhubarb, olives, plant parts such as leaves, tree bark, roots, woods optionally after a chemical/enzymatic modification and/or by extractive methods.

Component c)

By way of further added substances, the material according to the invention may or may not contain emulsifiers of component c). Useful emulsifiers include for example cationic, anionic, amphoteric or nonionic surfactants, which are preferably capable of lowering the interfacial tension between an organic and an aqueous phase such that an oil-in-water emulsion can form.

Preferred cationic emulsifiers are quaternary ammonium compounds, for example cetyltrimethylammonium bromide or chloride or benzyllauryldimethylammonium chloride.

Preferred anionic emulsifiers are soaps, metal soaps, organic soaps such as mono-, di- or triethanolamine oleate or stearate, diethylethanolamine oleate or stearate or 2-amino-2-methylpropan-1-ol stearate, sulphurated compounds such as sodium dodecylsulphate or Turkey Red oil and sulphonated compounds such as sodium cetylsulphonate.

Preferred amphoteric emulsifiers are phosphatides such as lecithins, various proteins such as gelatine or casein and the actual amphosurfactants.

Preferred nonionic emulsifiers are fatty alcohols such as lauryl, cetyl, stearyl or palmityl alcohol, partial fatty acid esters of polyhydric alcohols with saturated fatty acids such as glycerol monostearate, pentaerythritol monostearate, ethylene glycol monostearate, or propylene glycol monostearate, partial fatty acid esters of polyhydric alcohols with unsaturated fatty acids such as glycerol monoleate, pentaerythritol monoleate, also polyoxyethylene esters of fatty acids such as polyoxyethylene stearate, addition-polymerization products of ethylene oxide and propylene oxide onto fatty alcohols such as fatty alcohol polyglycol ethers or fatty acids such as fatty acid ethoxylates.

Particularly preferred nonionic emulsifiers are at least one nonionic, ester group-containing, alkoxylated polyol having an HLB value of at least 13 (c1) and/or an alkylglycoside (c2) and/or a nonionic alkoxylated alcohol free of ester groups (c3).

Component c1)

The preferred nonionic alkoxylated polyols of component c 1) which contain ester groups have an HLB value of 13 to 19, and especially of 14 to 18, the HLB value being determined by the method of Griffin, W. C.: Classification of surface active agents by HLB, J. Soc. Cosmet Chem. 1, 1949. Preferred compounds of component (c1) also have a water solubility at 20° C. of at least 10 g per litre and especially at least 20 g per litre.

Preferred compounds of component c1) are obtainable in a conventional manner from polyols by alkoxylation and partial esterification of the hydroxyl groups with a carboxylic acid. Suitable starter polyols include for example polyhydric (cyclo)aliphatic alcohols such as glycerol, trimethylolpropane, pentaerythritol, dipentaerythritol, mono- or polysaccharide-derived polyols, preferably of molecular weight in the range from 92 to 2000. Particularly preferred starter alcohols are polyols having 3 to 10 hydroxyl groups, especially glycerol and those of sorbitan core scaffold, especially of 1,4- or 1,5-sorbitan and preferably of 1,4-sorbitan.

Preferred aqueous compositions are characterized in that the compound of component c1) is the reaction product of a polyol with at least one alkylene oxide of 2 to 6 carbon atoms, preferably in an amount of 10 to 60 mol equivalents, based on the polyol and subsequent reaction with at least one carboxylic acid of 6 to 30 carbon atoms. The polyol used is preferably a polyol from the group consisting of glycerol, trimethylolpropane, pentaerythritol, dipentaerythritol and polyols derived from mono- and polysaccharides, especially sorbitol and polyols with sorbitan core scaffold.

It is particularly preferable for the compounds of component c1) to be partially esterified sorbitan alkoxylates, the hydroxyl groups of which have been esterified with carboxylic acids having a chain length of 6 to 30 carbon atoms before or preferably after alkoxylation, in which case each hydroxyl group of the parent polyol may display a mutually independent number of alkoxy units and on average from 10 to 60 alkoxy units are present per sorbitan unit. The preferred esterified sorbitan alkoxylates comprise a random distribution of the alkoxy groups.

Partially esterified alkoxylated sorbitan derivatives are preferably prepared by reaction of a sorbitan of formula $$X—(OH)_m$$

where

X is a sorbitan radical, especially a 1,4-sorbitan radical, and m represents the number 4, with 10 to 60 equivalents, per mole of sorbitan, preferably 10 to 40, more preferably 10 to 30 and most preferably 15 to 25 equivalents of identical or different $C_2$-$C_6$-alkylene oxides, especially $C_2$- and/or $C_3$-alkylene oxides, preferably ethylene oxide, and with 1 to 3, preferably 0.8 to 1.2 equivalents, based on the sorbitan, of an aliphatic, optionally unsaturated carboxylic acid, preferably having a chain length of 6 to 30 carbon atoms, which carboxylic acid is unsubstituted or substituted by hydroxyl groups and preferably is straight chain, in any desired order. Preferably, the reaction with the alkylene oxide is carried out before the reaction with the carboxylic acid.

Preference is given to sorbitan polyoxyethylene monoesters alkoxylated with 10-60 mol of ethylene oxide units per sorbitan unit and preferably having a 1,4-sorbitan core scaffold.

These preferably conform to the following structural formulae in which

R represents an optionally hydroxyl-substituted alkyl or alkenyl radical of the carboxylic acid and m, n, p and q are each independently statistical values and in the range from 0 to 60, with the proviso that the sum total of the number of oxyethylene units m+n+p+q is in the range from 10 to 60, preferably 18 to 22 and especially 20.

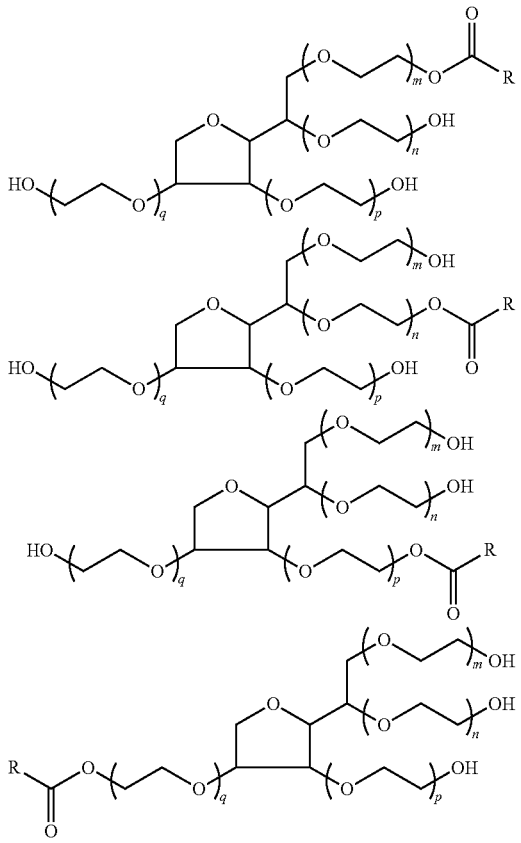

Corresponding alkoxylated sorbitan diesters and mixtures thereof are likewise suitable.

It is further possible to use alkoxylated sorbitan esters wherein one hydroxyl group of the sorbitan unit, especially in the above-indicated formulae is directly esterified with the carboxylic acid, i.e. where there is no alkylene oxide unit between the sorbitan unit and the carboxylic acid radical and the three non-acylated hydroxyl groups are etherified with a correspondingly higher number of alkylene oxide units. Such compounds are obtainable for example by first esterifying the sorbitan with a carboxylic acid and then alkoxylating the resulting product, consisting of a mixture of the isomeric monoesters which, in the case of an excess of carboxylic acid, can also contain mixtures of the isomeric diesters.

The alkylene oxide used to alkoxylate the sorbitan is preferably selected from the group consisting of ethylene oxide, propylene oxide and butylene oxide. It is also possible here for the sorbitan to be reacted with various alkylene oxides mentioned, for example ethylene oxide and propylene oxide, in which case sorbitan alkoxylates are obtainable that each include blocks of multiple units of an alkylene oxide, for example ethylene oxide, alongside blocks of multiple units of another alkylene oxide, for example propylene oxide. It is particularly preferable for the sorbitan alkoxylates to contain ethylene oxide (EO) units, preferably exclusively. In such a case, the alkylene oxide used is particularly preferably ethylene oxide.

It is further possible, when reacting a sorbitan with various of the alkylene oxides mentioned, for example ethylene oxide and propylene oxide, to obtain sorbitan alkoxylates in which the various alkylene oxides are incorporated randomly. The amounts used of alkylene oxide are preferably in the range from 10 to 60 mol of alkylene oxide per mol of sorbitan, more preferably in the range from 10 to 40 mol, even more preferably in the range from 10 to 30 mol and most preferably in the range from 15 to 25 mol. Ethylene oxide is the totally preferred alkylene oxide.

The carboxylic acids suitable for esterifying the starter polyol and particularly the sorbitan alkoxylate are preferably saturated or unsaturated and linear or branched and can optionally be substituted by hydroxyl groups. The following carboxylic acids may be mentioned by way of example: hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, octadecenoic acid (oleic acid), undecenoic acid. Particular preference is given to decanoic acid, undecanoic acid, dodecanoic acid (lauric acid), tetradecanoic acid, hexadecanoic acid (palmitic acid) and octadecanoic acid (stearic acid), ricinoleic acid. Very particular preference is given to dodecanoic acid (lauric acid), hexadecanoic acid (palmitic acid) and octadecanoic acid (stearic acid) and octadecenoic acid (oleic acid).

Compounds useful as component c 1) include, for example, commercially available products, for example sorbitan polyoxyethylene (20) monolaurate (for example Polysorbat® 20 or Tween® 20 (Croda Oleochemicals) or Eumulgin® SML 20 (Cognis)), sorbitan polyoxyethylene (20) monopalinitate (for example Polysorbat® 40 or Tween® 40 (Croda Oleochemicals)), sorbitan polyoxyethylene (20) monostearate (for example Polysorbat® 60 or Tween® 60 (Croda Oleochemicals) or Eumulgin® SMS 20 (Cognis)), sorbitan polyoxyethylene (20) monoleate (for example Polysorbat® 80 or Tween® 80 (Croda Oleochemicals)).

Further preferred compounds for component c1) are for example alkoxylates of mono- and polyglycerol esters. Such alkoxylated (poly)glycerol esters are prepared either by alkoxylation of glycerol or of a polyglycerol and subsequent esterification with a fatty acid, or by esterification of the glycerol or polyglycerol with a fatty acid and subsequent alkoxylation. Compositions according to the invention suitably utilize especially alkoxylates of mono- and polyglycerol esters which have an HLB value of at least 13 and preferably have a water solubility at 20° C. of more than 10 g per litre. It is further possible to use alkoxylated glycerol esters or polyglycerol esters which are esterified with more than one carboxylic acid. Alkoxylated monoglycerol monoesters are particularly preferred.

$C_2$ to $C_6$-Alkylene oxides are suitable for use in the alkoxylation, more preferably ethylene oxide. Preference is given to an alkoxylation with 10 to 100 alkylene oxide units, especially with 20 to 60 alkylene oxide units. The hydroxyl groups of the glycerol or polyglycerol each independently display on average a different number of alkylene oxide units.

As particularly suitable alkoxylates of mono- and polyglycerol esters there may be mentioned for example: glycerol monostearate ethoxylates having on average from 15 to 30 and especially on average 20 EO units, glycerol monoleate ethoxylates having 20 to 40 EO units, digylcerol monostearate having 20 to 40 EO units, polyglycerol monostearate having 20 to 40 EO units, castor oil alkoxylates and hydrogenated castor oil alkoxylates, in short: (hydrogenated) castor oil alkoxylates. The latter are products which are obtainable by alkoxylation of castor oil or hydrogenated castor oil with alkylene oxides, especially ethylene oxide and propylene oxide, and preference is given to those which include from 20 to 100 alkylene oxide units per (hydrogenated) castor oil unit and preferably from 20 to 60 ethylene oxide units per (hydrogenated) castor oil unit.

Corresponding glycerol-based compounds of components b1) are likewise available as commercial products, for example glycerol monostearate ethoxylate having on average 20 EO units as Cutina® E 24 (Cognis), hydrogenated castor oil ethoxylate having on average 40 EO units as Eumulgin® HRE 40 (Cognis).

Component c2)

Preferred compounds for component c2) are for example alkyl monoglycosides, alkyldiglycosides, alkyltriglycosides and higher homologues, here generally referred to as alkylglycosides, especially monoglucosides, diglucosides, triglucosides, or higher homologues and mixtures thereof, the hydroxyl groups of which are partially substituted with $C_6$-$C_{18}$-alkyl groups. Preference is given to mixtures of mono-, di- and triglucosides and higher homologues with $C_6$-$C_{18}$-alkyl groups, and a degree of polymerization (DP) of 1 to 5. Particular preference is given to alkylglucosides whose alkyl groups have a chain length of 6 to 18 carbon atoms and especially 6 to 12 carbon atoms. Preference is further given to alkylglucosides whose alkyl groups have a chain length distribution or constitute mixtures of alkylglucosides having different alkyl chains.

Alkylglycosides are preferably substances which consist of a single ring of a sugar or of a chain of rings of a sugar which are interlinked by glycosidic bonds, wherein the last ring of the glycosidic chain is acetalizated with an alcohol. Alkylglycosides have the following general formula:

$$H\text{-}(G)_w\text{-}O\text{—}R'$$

where

G represents a glycosidic unit,

R' represents the alkyl radical of an alcohol used for forming glycosidic acetal, and w represents the average degree of polymerization, i.e. the number of linked glycosidic units, and a number from 1 to 5.

In suitable alkylglycosides, w represents a number from 1 to 5 and R represents the radical of a linear or branched aliphatic alcohol having 6 to 30 carbon atoms. These products are known per se and commercially available. The value of w can be influenced in the course of the synthesis by appropriately adjusting the molar ratio of alcohol to saccharide. Increasing this ratio gives alkylglycosides having a lower average value of w. Conversely, a higher degree of polymerization is achieved via a low molar ratio of alcohol to saccharide.

An example is the structure of an alkylglucoside where R' represents an alkyl radical and v assumes values from 1 to 4:

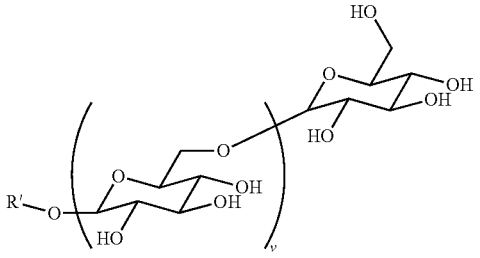

The compounds are generally present in the form of isomeric mixtures. Especially the anomeric carbon atoms (glycosidic carbon atoms) will be present as mixtures of the stereoisomers.

The preferred alkylpolyglucosides constitute mixtures of alkylmonoglucoside, alkyldiglucoside and alkyltriglucoside with or without alkyloligoglucoside which will vary with the molar ratio of the starting materials and as a function of the process conditions and which possibly still contain (poly) glucoses and small fractions of the free alcohol R'OH.

Alkylpolyglucosides are obtainable for example via a direct synthesis proceeding from a sugar with an excess of one or more alcohols. An alternative method of synthesis proceeds from starch which, in an initial step, is reacted with lower alcohols (e.g. methanol, ethanol, butanol) in the presence of an acid catalyst to form an alkylglucoside having a short-chain glycosidic group (e.g. methyl, ethyl, butyl). This intermediate is reacted in a subsequent step with the long-chain alcohol R'—OH under vacuum in the presence of an acid as catalyst by a transacetalization in which the equilibrium is shifted by distilling off the lower alcohol. The preparation of alkylglucosides is described for example in WO90/001489. U.S. Pat. No. 5,576,425, DE 69824366 or a paper by M. Biermann (Henkel KGaA), K. Schmid, P. Schulz in Starch-Stärke, vol. 45(8), p. 281-288 (1993).

Particularly preferred alkylglueosides include especially hexylglucoside, octylglucoside, decylglucoside, undecylglucoside, and dodecylglucoside and also their homologues and also the mixture of alkylmonoglucoside, alkyldiglucoside, alkyltriglucoside with or without alkylpolyglucoside and mixtures thereof.

Alkylglycosides where the sugar residue is constructed from various sugar units are also suitable. But particular preference is given to alkylglycosides constructed exclusively of glucose units.

The compounds of component c2) are commercially available in that, for example, a $C_8$-$C_{10}$-alkylpolyglucoside having a degree of polymerization (DP=degree of polymerization) of 1.6 is available under the trade name Glucopon® 215 CS UP (Cognis). A $C_{12}$-$C_{16}$-alkylpolyglucoside having a DP of 1.4 is available under the trade name Glucopon® 600 CS UP (Cognis) for example.

Component c3)

Preferred nonionic, ester group-free alcohol alkoxylates of component c3) are suitably polyether alcohols obtainable in a conventional manner by alkoxylation of suitable starter molecules. These are known from EP-A-1647563 for example. The polyether alcohols are preparable using any desired mono- or polyhydric alcohols of molecular weights 88 to 438 as starter molecules.

It is particularly preferable for alkoxylates of aliphatic alcohols with a chain length of 5 to 30 carbon atoms and 1 to 25 alkoxy units to be concerned.

Preference is given to using linear or branched, saturated or unsaturated alcohol alkoxylates obtained by reacting at least one alcohol ROH with n mol of at least one alkylene oxide per mole of alcohol ROH, where R is an alkyl moiety of 5 to 30 carbon atoms which has a main chain of 4 to 29 carbon atoms which has at least one $C_1$- to $C_{10}$-alkyl branch attached in the chain middle;

the alkylene oxide has 2 to 6 carbon atoms, and n is from 1 to 25.

The chain middle for the purposes of the present invention comprehends those carbon atoms of the main chain, i.e. of the longest alkyl chain in the moiety R, beginning at the carbon atom C#2, the numbering starting with the carbon atom (C#1) that is attached directly to the oxygen atom adjacent to the moiety R, and ending with the carbon atom ω-2, where ω is the terminal carbon atom of the main chain and C#2 and the carbon atom ω-2 are included. This means that at least one of the carbon atoms C#2, C#3, . . . to $C_{\omega-2}$ of the main chain of the moiety R is substituted with a $C_1$- to $C_{10}$-alkyl moiety. It is preferably the carbon atom C#2 of the main chain of the moiety R which is substituted with a $C_1$- to $C_{10}$-alkyl moiety. But it is similarly possible for one or more carbon atoms in the chain middle to be substituted with two $C_1$- to $C_{10}$-alkyl moieties, i.e. for one or more carbon atoms in the chain middle to be quaternary carbon atoms.

Particularly preference is given to a mixture of alcohol alkoxylates based on 1 to 3 different alcohols ROH and more preferably on 1 or 2 different alcohols ROH. The number of carbon atoms in the moiety R may be different and/or the type of branching.

The main chain of the alcohols ROH preferably has 1 to 4 branches when the chain length permits more than one branching point in the chain middle, more preferably 1 to 3 and most preferably 2 or 3. These branches generally independently have 1 to 10 carbon atoms, preferably 1 to 6 and more preferably 1 to 3. Particularly preferred branches are accordingly methyl, ethyl, n-propyl or isopropyl groups.

The moiety R of the alcohol ROH is preferably of 5 to 30 carbon atoms. Since the moiety R preferably has at least one branch with at least one carbon atom, the main chain comprises 4 to 29 carbon atoms. The moiety R preferably is of 6 to 25 carbon atoms and more preferably of 10 to 20. That is, the main chain is preferably of 5 to 24 carbon atoms and more preferably of 9 to 19. It is very particularly preferable for the main chain to be of 9 to 15 carbon atoms, and the remaining carbon atoms of the moiety R are distributed over one or more branches.

Preferred linear alcohols BOB include for example octyl alcohol, nonyl alcohol, decyl alcohol, undecyl alcohol, dodecyl alcohol, tridecyl alcohol, tetradecyl alcohol, pentadecyl alcohol, hexadecyl alcohol, octadecyl alcohol, octadecenyl alcohol or hexadecenyl alcohol and also technical grade mixtures thereof.

The alkylene oxide reacted with the branched alcohols ROH to form the alcohol alkoxylates used is preferably selected from the group consisting of ethylene oxide, propylene oxide and butylene oxide. It is also possible for a single alcohol ROH to be reacted with various recited alkylene oxides, for example ethylene oxide and propylene oxide, in which case it is possible to obtain alcohol alkoxylates which each comprise blocks of two or more units of one alkylene oxide, for example ethylene oxide, in addition to blocks of two or more units of the further alkylene oxide, for example propylene oxide. It is particularly preferable for the alcohol alkoxylates used according to the present invention to contain ethylene oxide (EO)) units; that is, the alkylene oxide used is preferably ethylene oxide.

It is further possible in the case of reacting a single alcohol ROH with various recited alkylene oxides, for example ethylene oxide and propylene oxide, to obtain alcohol alkoxylates in which the various alkylene oxides are incorporated in random fashion. The amounts used of alkylene oxide are preferably 1 to 25 mol of alkylene oxide per mole of alcohol, more preferably 1 to 20 mol, even more preferably 3 to 15 mol and most preferably 5 to 12 mol.

Further Added Substances

The material of the invention may additionally contain, or else not contain, further added substances, preferably carboxylic acids of component d) or salts thereof.

Component d)

Suitable compounds for component d) are especially mono- or polycarboxylic acids, preferably hydroxyl-polycarboxylic acids. Suitable examples include: formic acid, acetic acid, oxalic acid, glyoxylic acid, malonic acid, lactic acid, tartaric acid, maleic acid, glutaric acid, phthalic acid, adipic acid, malic acid, succinic acid, citric acid, or polycarboxylic acids such as (co)polymers of (meth)acrylic acid, maleic acid, crotonic acid or itaconic acid or derivatives thereof with optionally further monomers such as ethene, propene, styrene, hydroxyethyl methacrylate, hydroxypropyl methacrylate, hydroxyethyl acrylate, hydroxypropyl acrylate, 4-hydroxybutyl vinyl ethers, especially those having an average molar mass (weight average Mw) of 500 to 100000 g/mol, especially 500 to 30000 g/mol.

Particular preference for use as component d) is given to at least one carboxylic acid, preferably oxalic acid, succinic acid, glutaric acid, or adipic acid, especially at least one hydroxy-polycarboxylic acid, preferably citric acid, tartaric acid or lactic acid or mixtures thereof.

Component e)

By way of preferred further added substances of component e), auxiliaries such as fatliquoring agents, dustproofing agents, buffers and/or fillers may preferably be included or not included.

Fatliquoring agents are preferably substances based on biological, mineral or synthetic oils which, to improve their utility in water, can be provided with hydrophilic groups, for example via complete or partial sulphatization, sulphitization, carboxylation or phosphatization.

Possible fillers are preferably inert inorganic salts and also organic polymers, for example sulphates such as sodium sulphate or calcium sulphate, talc, silicon oxide compounds, starch or ligninsulphonates.

Suitable buffers are buffers which, on addition in a sufficient amount, are capable of setting and stabilizing a pH range, especially a pH range from 1 to 5 and preferably from 2.0 to 3.5. Suitable buffers for this are preferably mixtures of compounds of component d) and salts thereof. Preferred salts are especially alkali metal salts, preferably sodium or potassium salts.

Preferred dustproofing agents include for example alkoxylates of aromatic compounds or polyethers or certain diesters. Specific examples are: ethoxylates, propoxylates or mixed polyethers based on EO-PO, where hydroquinone or phenol-styrene may be mentioned as aromatic compounds, polyethylene glycol having an average molar mass of 100 to 800, polypropylene glycol having an average molar mass of 100 to 800, EO-PO mixed polyethers having an average molar mass of 100 to 800, monoalkyl ethers or dialkyl ethers of the abovementioned polyethers, wherein the alkyl moiety may be of 1 to 4 carbon atoms. Dustproofing agents based on mineral oil are also suitable. Dustproofing agents are preferably used in an amount of 0 to 5.0, more preferably 0.1 to 2.0%, based on solid material according to the invention.

Amounts

The material according to the invention may additionally contain or not contain further added substances, in which case the amount of these added substances inclusive that of component c) to e) is preferably up to 30 wt%.

Preferably, the material according to the invention contains 10 to 99 wt%, especially 30 to 80 wt% of component a),
1 to 90 wt%, especially 18.99 to 70 wt% of component b),
0 to 5 wt%, especially 0.01 to 3 wt% of component c),
0 to 15 wt%, especially 1 to 10 wt% of component d),
0 to 15 wt%, especially 0 to 10 wt% of component e),
and
0 to 5 wt%, especially 0 to 2 wt% of water (residual moisture).

The weight ratio of component a):b) is preferably in the range from 1:100 to 100:1 and especially in the range from 1:10 to 10:1.

The material according to the invention preferably contains no additional component apart from a) and b) and optionally c), d) and water. In a particularly preferable embodiment, the material according to the invention consists exclusively of the components a), b) and optionally water (residual moisture) to an extent of more than 98 wt%, preferably to an extent of more than 99.5 wt% and especially to an extent of more than 99.8%.

It is preferable for the material according to the invention to contain

- 10 to 90 wt%, especially 30 to 70 wt% of compound containing carbamoylsulphonate groups of component a),
- 10 to 90 wt%, especially 30 to 70 wt% of component b), and
- 0 to 5 wt%, especially 0 to 2 wt% of water (residual moisture), all based on the material, It is likewise preferable for the material according to the invention to additionally contain 0 to 10 wt%, especially 0 to 5 wt% and most preferably 0.01 to 3% of component c), preferably component c1), c2) or c3), all based on the material.

In one particular embodiment, the material according to the invention may also contain reaction products of polyisocyanates or polyisocyanate-bisulphite adducts and the OH-functional emulsifiers such as, for example, the partially esterified polyol alkoxylates (component c), which reaction products contain urethane groups and optionally have carbamoylsulphonate end groups.

Such reaction products are also obtainable for example by reaction of an excess of polyisocyanate with component c), and advantageously useful as added substance.

In a likewise particular embodiment, the material according to the invention also contains reaction products of polyisocyanates and polyisocyanate-bisulphite adducts and citric acid. Such reaction products, which contain urethane groups and carbatnoylsuiphonate groups, are obtainable, for example, by reaction of an excess of polyisocyanate with component d) and subsequent reaction with a bisulphite and/or disulphite. Compounds of this type are for example bisurethanes formed from 1 mol of hexamethylene diisocyanate and 2 mol of citric acid or, for example, the monourethane formed from 1 mol of hexamethylene diisocyanate and 1 mol of citric acid, while remaining NCO groups react in situ with bisulphite and/or disulphite to form the carbamoylsulphonate groups.

Particularly preferred compositions are those containing compounds containing carbamoylsulphonate groups and obtained by reaction of at least one organic isocyanate with at least one bisulphite and/or disulphite and at least one carboxylic acid, in particular a hydroxy-polycarboxylic acid (component d), especially citric acid, preferably in an amount of 0 to 3, preferably 0 to 2 wt%, based on the composition, in the presence of a compound of component c1).

The preferred materials according to the invention contain less than 5%, particularly less than 1% of dimeric, trimeric or polymeric carbamoylsulphonates which contain urea groups and may be byproduced in the course of synthesis by hydrolysis of polyisocyanates.

Production

The invention further provides a process for producing the solid particulate material according to the invention, said process being characterized in that components a and b) are mixed with or without further added substances.

The compound of component a) is also obtainable for example by reacting at least one organic polyisocyanate with at least one bisulphite and/or disulphite in an organic or aqueous-organic solvent such as water-dioxane for example similarly to the procedure of DE102006056479-A1.

The invention further provides a process for producing the solid particulate material according to the invention, said process being characterized in that at least one organic polyisocyanate is reacted with at least one bisulphite and/or disulphite in the presence of water, the component b) and optionally the component c) and optionally a carboxylic acid of component d), optionally admixed with further added substances, and either the particulate material is precipitated with an organic solvent and subsequently dried or the reaction mixture is dried.

The invention further provides a process for producing the solid particulate material according to the invention, said process being characterized in that at least one organic polyisocyanate is reacted with at least one bisulphite and/or disulphite in the presence of water and optionally the component c) and optionally a carboxylic acid of component d), admixed with component b) and optionally further added substances, and the reaction mixture obtained is dried, especially spray dried.

It is particularly preferable with this version of the process according to the invention that the preparation of component a) is effected by reacting at least one organic polyisocyanate with at least one alkali metal or ammonium bisulphite and/or disulphite in water in the presence of component c), especially component c1).

It is very particularly preferable with this version of the process according to the invention that the preparation of component a) is effected by reacting at least one organic polyisocyanate with at least one alkali metal or ammonium bisulphite and/or disulphite in water in the presence of component c), especially component c1) and optionally in the presence of component d).

Reaction times of 1 to 12 and preferably 1 to 6 hours are generally sufficient for this, depending on the organic polyisocyanate used and the reaction temperature. The reaction preferably takes place at a temperature of 0 to 100° C., preferably at 10 to 80° C. and more preferably at 10 to 60° C. It is particularly preferable to use alkali metal bisulphites or alkali metal disulphites.

The organic polyisocyanates are reacted with alkali metal or ammonium bisulphite and/or disulphite in water preferably at 0 to 100° C., more preferably at 10 to 80° C. and even more preferably at 10 to 60° C. in the presence of at least one compound of component c1) until all NCO groups have reacted.

Again, reaction times of 1 to 12 and preferably 1 to 6 hours are generally sufficient for this purpose, depending on the organic polyisocyanate used and the reaction temperature.

Especially 0.001 to 5 wt%, especially 0.01 to 3 wt% of component c), all based on the material, or 0.001 to 2.5, preferably 0.01 to 1.5% of component c), based on the aqueous reaction mixture, is used before or during the addition of the polyisocyanate, the aqueous reaction mixture having a solids content of 10% to 50% and more preferably of 25% to 45%.

Very particular preference is also given to a version of the process according to the invention wherein the preparation of component a) is effected by reacting at least one organic polysocyanate with at least one alkali metal or ammonium bisulphite and/or disulphite in water in the absence of component c), and optionally in the presence of component d).

It is likewise preferable to perform the reaction in the presence of a carboxylic acid, preferably oxalic acid, succinic acid, glutaric acid or adipic acid, especially at least one hydroxy-polycarboxylic acid, preferably citric acid, tartaric acid or lactic acid or mixtures thereof.

Especially 0 to 3, preferably 0 to 2% of component d), based on the aqueous reaction mixture, is used even during the reaction of the polyisocyanate with the bisulphite/disulphite. It is particularly preferable to add a hydroxy-polycarboxylic acid of component d) even before or during the synthesis of component a). Preferably, 10% of the entire amount of component d) is added even before or during the reaction of the polyisocyanate with the bisulphite/disulphite.

The aqueous compositions used for drying preferably have a pre-drying pH of 1 to 5, more preferably of 2.0 to 3.5, when drying does not take place immediately after preparing the solution.

The aqueous compositions used for drying preferably have a pre-drying pH of 1 to 7, more preferably of 2.0 to 6.0, when drying does Lake place immediately after preparing the solution.

To set this pH, it is advantageous for the composition to be adjusted and stabilized to the suitable pH range, especially a pH range from 1 to 5, preferably 2.0 to 3.5, by addition of a sufficient amount of a buffering substance. Useful organic buffers for this are preferably mixtures of compounds of component d) and salts thereof. Preferred salts are especially alkali metal salts, preferably sodium or potassium salts.

The use of a hydroxy-carboxylic acid, especially citric acid, during the synthesis is also very advantageous from a technical point of view. The rate of the exothermic reaction with the bisulphite is surprisingly easy to influence in this way, and offers an additional advantage and an increased measure of safety in the reaction conduct.

In one particular embodiment, the solid particulate material according to the invention also contains reaction products of polyisocyanates or polyisocyanate-bisulphite adducts and citric acid. Such reaction products, which contain urethane groups with or without carbamoylsulphonate groups, are also obtainable for example by reaction of an excess of polyisocyanate with component d). Compounds of this type are for example bisurethanes formed from 1 mol of hexamethylene diisocyanate and 2 mol of citric acid or for example the monourethane formed from 1 mol of hexamethylene diisocyanate and 1 mol of citric acid, while remaining NCO groups react with bisulphite and/or disulphite to form the carbamoylsulphonate group.

Especially 0.1 to 50, preferably 0.5 to 20 wt% of the compound of component c), based on the total amount of polyisocyanate used, is used for synthesis. The emulsifying power of components c) varies with the polyisocyanates used. Generally, however, it is preferable to use as little as possible of component c). It is therefore preferable to use an amount of 0.1 to 10 wt% of component c) based on the polyisocyanate used to emulsify the polyisocyanate.

It is further possible to prepare the compounds containing carbamoylsulphonate groups in a continuous manner, in which case the reaction components are fed in a continuous manner into a plant element which makes it possible for the components to become intimately mixed, and the reaction blend is reacted at elevated temperatures, preferably in the range from 20 to 100° C. and in the course of a short residence time adapted to the temperature, in a microreactor for example, to form the end product, the resulting reaction mixture is fed, optionally after adjusting the temperature, pH, concentration and adding further components, into a drying apparatus, and after the water has evaporated, the solid particulate material is discharged from the plant and filled into appropriate containers. Suitable microreaction systems include for example those from Ehrfeld BTS GmbH or GEA/Niro.

Components c), especially c1), c2) or c3) and optionally the components d) may likewise be added to the reaction in a continuous manner during the reaction.

Continuous operation makes it possible to set the reaction temperature at 20 to 100° C. The residence time in the reaction system can be shortened to a few minutes by elevating the reaction temperature.

In one preferable embodiment of continuous synthesis using a microreaction plant, a solution of alkali metal bisulphite or disulphite in water is mixed with component c). This mixture and the polyisocyanate are then added in a continuous manner separately and at a rate corresponding to a stoichiometric ratio of bisulphite groups ($HSO_3$—) to NCO groups in the range from 1.0:1.0 to 1.2:1.0 and preferably in the range from 1.0:1.0 to 1.05:1.0 to a mixer integrated in a microreaction plant. Microreaction plants of modular construction from Ehrfeld BTS GmbH can be used for continuous production for example. The two streams of liquid are preferably metered using pulsationless high-pressure pumps. The liquids fed to the mixer are intimately mixed by the microstructure of the mixer, routed through a heat exchanger and subsequently reacted in a microreactor at a temperature of 20 to 120° C., preferably using a residence time of a few seconds to 15 minutes such that complete conversion of NCO groups is obtained. After leaving the reactor, the aqueous product solution is cooled down by a heat exchanger and discharged from the microreaction system, via an outlet module, into a stirred container or intermediate container. The solution can then be mixed with component b) and optionally further added substances such as component c) or component d) in a continuous manner and then be routed directly into a spray dryer. The rate of metering the raw materials into the microreaction plant is advantageously conformed to the rate of discharging spray-dried material from the spray dryer. However, it is also possible for the reaction mixture leaving the microreaction plant to be discharged into a stirred container or storage container, from which the spray dryer can then be fed at a different rate. The spray-dryer inlet temperature setting is preferably in the range from 120 to 200° C. and preferably in the range from 130° C. to 180° C. When the solid material has a residual moisture content of more than 2%, it may be advantageous to perform a downstream, similarly continuous drying step in a fluidized bed dryer or paddle dryer for example to reduce the residual moisture content to a value below 2%. The material obtained is then filled into the appropriate containers in a continuous manner. It may be advantageous to add a dustproofing agent in the continuous process before, during or after the spray-drying operation for example in order to obtain a dustless product which is free-flowing and easy to meter by the user. The solid material obtained is very readily soluble in water (at 20 to 25° C.) and being a solid material is notable for outstanding storage stability even at high temperatures (60° C.).

The aqueous reaction mixtures, irrespective of whether or not an intervening isolation of the aqueous reaction blend is effected, are suitably dryable in conventional apparatuses such as spray dryers, thin film evaporators, evaporative screws, apparatuses for cooling crystallization or vacuum dryers such as apparatuses for freeze drying or vacuum dryers with forced conveyance. Spray dryers are particularly suitable, including as the case may be spray dryers with integrated fluidized bed drying. Redrying the predried product can be necessary to minimize the residual moisture content. The residual moisture content is typically in the range from 0 to 5%, preferably in the range from 0 to 2% and more preferably in the range from 0 to 1%, based on solid material.

Spray drying in particular is a suitable drying process, preferably single-product spray drying using high-pressure or spinning-chamber nozzles or spray drying using atomizing discs, freeze drying with up- or downstream granulation or dry processing, accretional granulation for example by the pan or drum granulation process optionally with partially predried product, fluidized bed drying and granulation, mixed agglomeration and drying optionally combined with fluidized or moving bed drying. Further possibilities are processes such as mixed agglomeration in suspension with optionally downstream fluidized or moving bed drying, granulation by paste shaping and downstream redrying and commination or pelletization and also steam jet agglomeration. Combinations of the processes mentioned are likewise possible.

Particular preference is given to the processes of spray drying using high-pressure or spinning-chamber nozzles, spray drying with integrated and/or downstream fluidized bed agglomeration and/or fluidized bed drying, accretional granulation by the pan process and also fluidized bed granulation and drying.

The solid material according to the invention is obtainable using various methods. Three methods will now be briefly described.

Method 1 Precipitating the Compound Containing Carbamoylsulphonate Groups from Aqueous Solution.

The particulate material is precipitated with an organic solvent from an aqueous solution obtained by at least one organic polyisocyanate being reacted with at least one bisulphite and/or disulphite in the presence of water and optionally component c) and optionally a carboxylic acid of component d) and optionally admixed with further added substances. Precipitation is effected by mixing the aqueous solution with an excess of an at least partially water-miscible precipitant for component a), preferably ethanol, methanol, n-propanol, isopropanol, methoxypropanol, acetone, methyl ethyl ketone or ethyl acetate. Acetone is very particularly preferable.

The aqueous solution to be used preferably has a solids content of 10 to 50 wt% and more preferably of 25 to 45 wt%. When acetone or methyl ethyl ketone is used as precipitant, the compound containing carbamoylsulphonate groups is obtainable in particular purity.

The aqueous solution to be used preferably has a pH of 2.0 to 6.0, more preferably a pH of 2.3 to 4.0 and most preferably a pH of 2.5 to 3.5.

Precipitation with the organic solvent is preferably effected below the boiling point of the organic solvent, more preferably below 50° C. and most preferably in the temperature range from 0° C. to 40° C.

The organic solvent is preferably used in excess. The water to solvent weight ratio is preferably in the range from 1:1 to 1:10 and more preferably in the range from 1:1 to 1:5. The organic solvent may be added to the aqueous solution contain the compound containing carbamoylsulphonate groups, or the aqueous solution may conversely be added to the initially charged organic solvent. In general, the mixture is stirred during the precipitating step.

The precipitated product is subsequently separated off, preferably by decanting, centrifuging or filtration, preferably by sucking off using filter media, for example using a pressure nutsche, a chamber filter press, optionally washed with fresh solvent and subsequently dried. Separation can also be effected in a continuous manner in combination with the above-described continuous process for producing the aqueous solution. The solid material is preferably dried under reduced pressure at a temperature of −20 to +40° C. Preferably, the temperature is kept very low at the start of drying and is elevated to the end temperature towards the end of drying.

The yield of solid material is almost quantitative in most cases when acetone is used as precipitant and the recited drying conditions under reduced pressure and a temperature of −20 to +40° C. are employed. The filtrate obtained on removal of the solid material can subsequently be reprecipitated if necessary. The combined filtrates are thereafter preferably worked up in suitable form, for example via a vacuum distillation, to recover the organic solvent.

Component b) is preferably added to the precipitated component a), but can also be added to component a) before precipitation.

Method 2

Drying an Aqueous Solution Containing the Compound Containing Carbamoylsulphonate Groups Via Thermal Processes of Drying.

An aqueous solution obtained by at least one organic polyisocyanate being reacted with at least one bisulphite and/or disulphite in the presence of water and optionally component c) and optionally a carboxylic acid of component d) is mixed with component h) and optionally with further added substances, and the resulting mixture has a solids content of 10 to 50% and more preferably of 35 to 50% and is spray dried as described hereinbelow.

The aqueous solution to be used preferably has a pH of 2.0 to 6.0, more preferably a pH of 2.3 to 4.0 and most preferably a pH of 2.5 to 3.5.

The aqueous solution fed to the dryer is preferably set to a temperature below 50° C. and most preferably to a temperature in the range from 10° C. to 40° C.

Technical apparatuses customary in drying technology are suitable for drying duty. Particular preference is given to processes involving the use of spray dryers. Any known process variant is suitable. Suitable are for example spray drying towers with single-substance nozzles where the aqueous solution is injected at the top end of the spray dryer using overpressure, while the particle size is adjustable inter alia via the nozzle diameters used. Also suitable are for example spray dryers with a disc atomizer, where the aqueous solution is applied to an externally driven rotating cam and is finely dispersed by centrifugal forces. The inlet temperature in the spray dryer is for example 100° C. to 250° C. but preferably 110° C. to 200° C. and more preferably 110° C. to 180° C. The outlet temperature is for example in the range from 20 to 100° C., preferably in the range from 30° C. to 90° C. and more preferably in the range from 50 to 90° C.

The residual moisture content of the powder obtained is preferably below 10%, more preferably below 5%, even more preferably below 2% and most preferably below 1%.

The compounds obtained as containing carbatnoylsulphonate groups are preferably generated as colourless powders which are only low-dusting. It may possibly be advantageous for the material to be dried to have a dustproofing agent added to it before, during or after spray drying. In this case, it is preferable to add the dustproofing agent to the aqueous solution. It is further possible to introduce the dustproofing agent into the dryer during the spray-drying operation. It is further possible for the powder obtained to be surface coated with a dustproofing agent.

Useful dustproofing agents include those mentioned above.

Method 3=Isolating the Solid Material Via Cryotechniques

It is also possible for the compound containing carbamoylsulphonate groups to be isolated from the aqueous solution described under Methods 1 and 2 by precipitation via cooling crystallization or by working-up via freeze drying. The working-up is preferably effected in known manner through mechanical removal of the solid or respectively by evaporating the water from the frozen aqueous solution.

Component b) is preferably added to the precipitated component a), but can also be added to component a) before precipitation.

The spray-drying process as per Method 2 is very particularly preferred for drying the aqueous reaction mixtures.

It is possible for further added substances to be optionally admixed to the spray-dried powder of component a) which already contains component b), optionally also component c), d) and e). It is particularly preferable for a liquid composition containing the components a), b) and optionally c), d) and e) to be subjected to a conjoint spray-drying of the mixture. It is likewise possible for components b) and optionally d) and optionally e) to be admixed in solid form to the previously dried material formed of component a) and optionally c).

It was found that, surprisingly, adding component b) to the aqueous reaction mixture containing component a) and optionally c) makes more rapid spray drying possible, which leads to an appreciable time saving in the drying operation.

Use

The solid particulate material obtained after spray drying or by mixing the individual components is generally obtained as low-dusting free-flowing powder containing the compounds containing carbamoylsulphonate groups. This powder is readily soluble in cold water and can be metered directly into the tanning drum as a solid material. Predissolving the powder with water is not necessary, but is likewise possible depending on the field of use. This aqueous solution obtained is sufficiently stable for use at a pH of 6 to 8 for example. When the material already contains component d) also, the aqueous solution has a significantly longer shelf life. It is also possible, by raising the proportion of component d), to adjust the properties of the powder such that an aqueous solution of the powder, on redissolving in water at 20° C., has a pH of 2 to 4. The resultant aqueous solutions of the pulverulent compositions are in this case storage-stable at 30° C. for several months.

When the pulverulent composition also contains further added substances of components c) to e) or other added substances which in turn contain components which do not form a completely clear solution in water, the aqueous solution of the corresponding pulverulent preparation which contains component a) may possibly spray a cloudiness due to such finely divided particles. But these fractions generally become gradually incorporated into the leather cross-section during the tumbling operation in the tanning drum, so that a clear float will be left over at the end of the tanning operation.

It is preferable to meter the solid particulate material of the present invention directly into the tanning drum in solid form. The solid particulate material of the present invention is generally a fine free-flowing powder which can be metered simply and dustlessly and which becomes homogeneously dispersed/dissolved in water within a few seconds to minutes. As the material comes into contact with the water surface, there is no clumping and thereby any damage to the substrate in the tanning operation due to local overconcentration of active ingredient is thereby avoided.

Specific conventional processes in drying technology can also be used to produce specific structures of solid compositions, such as blackberry structures or structures with core-shell construction. This makes it possible to adjust the dissolution characteristics of solid compositions in water within wide limits. From instant powders to slow-release preparations or products providing continuous and linear release of components or an incremental dissolution of constituents over time during the tanning operation. For instance, the pH during the tanning operation can be controlled for example through slow release of a solid base or solid acid such that involved pH control of the tanning operation is not required, but takes place virtually automatically.

The invention further provides for the use of the solid particulate material of the present invention as pretanning agents, tanning agents or else retanning agents for hides and skins.

A pretanning agent for the purposes of this invention is a product whereby a hide or skin can be converted into a state which permits commercial mechanical treatments such as samming or shaving, but requires further treatment steps with tanning substances for finalizing the leather or fur.

The invention fur provides a process for tanning hides and skins, which is characterized in that hides or skins pretreated by washing, liming, optionally unhairing and deliming are treated with the material according to the invention.

The invention likewise provides the wet white leather obtained by the tanning process of the invention, a wet white leather being a chromiumlessly tanned leather intermediate product for mechanical treatment and further (re)tanning.

It will be appreciated that unhairing is omitted for the tanning of skins.

The appropriately pretreated hides (called pelts hereinafter), which are preferably unhaired, are preferably treated in a commercially available tanning drum in aqueous float at a temperature of 10° C. to 60° C. and a pH of 5 to 10, preferably 7 to 9 with 0.5 to 10%, preferably 1 to 4%, (based on the proportion of pure component a)), of the material according to the invention such that a tanned intermediate product having a shrinkage temperature of at least 65° C., preferably at least 68° C. and more preferably at least 70° C. is obtained. The shrinkage temperature is determined by methods known to a person skilled in the art, for example by heating the tanned intermediate product by immersion in a water bath whose temperature is raised at a certain heating rate until the material is observed to contract. The temperature reached at the point of contraction is read off on the display of the leather shrinkage tester. The shrinkage temperature can also be determined using the differential scanning calorimetry (DSC) method known to a person skilled in the art.

Preferably, after addition of the material according to the invention, the product is allowed to penetrate for preferably 0.1 to 8 h, more preferably 0.2 to 2 h at a pH in the section of the pelt from 8 to 10 and a float pH of 7 to 8, and then a fixing agent is added. Useful fixing agents include any bases known per se in tanning, or mixtures thereof, examples being aqueous sodium hydroxide solution, alkali metal carbonates, alkali metal bicarbonates, magnesium oxide, dolomite, tertiary amines and so on, but preferably dolomite, magnesium oxide, sodium carbonate and aqueous sodium hydroxide solution. Fixing preferably takes from 2 to 24 h, preferably 4 to 12 h at a float pH of 7 to 10, preferably a float pH of 7.0 to 8.5.

It is also possible to interrupt tannage by acidifying to pH 4 to 6 or addition of ammonia or of a primary or secondary amino compound. This is especially advantageous when excessive adstringency of the float is to be avoided and a partial deactivation of the tanning agent is desired. These additional measures are suitable for influencing the tanning operation in an advantageous manner.

Useful amino compounds include for example ethanolamine, diethanolamine, propylamine, butylamine, hydroxypropylamine, diamine, 3-aminopropyltriethoxysilane, 3-aminopropyltrimethoxysilane, N-(2-aminoethyl)-3-aminopropyltriethoxysilane, N-(2-aminoethyl)-3-aminopropyltrimethoxysilane, bis(3-triethoxysilylpropyl)amine, bis(3-trimethoxysilylpropyl)amine, hydroxyethylmorpholine, hydroxyethylcyclohexylamine, hydroxypropylmorpholine, hydroxypropylcyclohexylamine, hydroxyethylethylenediamine, hydroxypropylethylenediamine, bis(hydroxyethyl)ethylenediamine, bis(hydroxypropyl)ethylenediamine.

Especially the abovementioned silanes are useful for additionally constructing a three-dimensional secondary network within the substrate, during the tanning operation, by hydrolysis to silanol groups and self-condensation of silanol groups to polysiloxanyl groups, and therefore can make an advantageous contribution to further stabilizing the hide material. The presence of mineral fillers can also amplify the stabilizing effect. Suitable mineral fillers include for example silica-containing materials such as hydrolytically produced or pyrolytically produced silicas, ground glasses, sheet-silicates, aluminosilicates, zirconium dioxide, titanium dioxide. Such mineral fillers may also have a surface which has been, by the use of organo-functional silanes, specifically treated and chemically modified. Such materials are commercially available. Hide stabilization is a desired effect, particularly from the use as pretanning agent and tanning agent, in order that the mechanical processing during the shaving operation may be positively influenced for example. Shrinkage temperature can also be favourably influenced thereby. These silanes can also be used in retanning in combination with the material of the present invention in order that the haptic properties (fullness, softness) and the colour properties (levelness, penetration) may be influenced.

It is particularly advantageous to choose a low initial float pH of 6 to 7 to penetrate the tanning agent and to manage the fixing in a pH range between 7.5 and 8.5 and by raising the temperature.

The tanned intermediate products obtained are useful for mechanical further processing by, for example, samming, shaving or splitting. In addition, these intermediate products are distinguished by a remarkably white, clear and lightfast self-colour, and this is a distinct advantage over leathers tanned with glutaraldehyde. The pretanned intermediate products can be retanned using commercial processes to provide soft and airy crust leathers.

The invention further provides a process for producing leather and furs, characterized in that prepared pelt material (i.e. skins conditioned for tannage or delimed and/or pickled pelt material) is treated in aqueous float at a temperature of 10° C. to 60° C. and a pH of 5 to 10, preferably 7 to 9 with 0.5 to 10%, preferably 1 to 4% (based on active content of component a)) of the material according to the invention until a tanned intermediate product having a shrinkage temperature of at least 65° C., preferably at least 68° C. and more preferably at least 70° C. is obtained.

When the shrinkage temperature is lower, the mechanical manipulation of the tanned intermediate products, i.e. the wet white material, on, for example shaving machines is problematical, since the wet white material sticks excessively to the blade rolls and is difficult to process. If, by contrast, tannage is allowed to proceed for longer, more tanning agent is added or fixation at higher pH values is carried out, significantly higher shrinkage temperatures can be achieved. However, these are not required for the mechanical manipulation of wet whites.

In a special embodiment of the invention, the properties concerning mechanical further processing and also the final leather properties can be adapted to customer requirements by the addition of the composition according to the invention being preceded, accompanied or followed by the addition to the tanning float of further substances typical in tannage.

They include conventional, commercially available organic tanning agents such as syntans, resin tanning agents, vegetable tanning agents, filling and softening polymeric (re)tanning agents, fatliquors and hydrophobicizing agents. These agents are preferably added in the following retanning steps in the amounts customary for wet white.

The tanning operation according to the invention is advantageous in that leathers having a broad spectrum of properties are obtainable and that the shavings generated in the course of mechanical manipulation can be widely used as raw materials, including for making useful products for application in the leathermaking operation. This makes a significant contribution to further reduce waste in leather production.

EXAMPLES

Organic Tanning Agents

G1: Tanigan® BN: pulverulent condensation product based on naphthalenesulphonic acid, 4,4'-di hydroxydiphenyl sulphone and formaldehyde.

G2: Tanigan® BN: pulverulent condensation product based on naphthalenesulphonic acid, 4,4-dihydroxydiphenyl sulphone and formaldehyde containing sodium phthalate as buffer.

G3: Tanigan® PR: 50% aqueous solution of a condensation product based on naphthalenesulphonic acid and formaldehyde.

G4: Tanigan® PR: pulverulent condensation product based on naphthalenesulphonic acid and formaldehyde containing sodium bisulphite.

G5: Tanigan® HO: pulverulent condensation product based on sulphonated ditolyl ether, sulphonated phenol and formaldehyde G6: Tanigan® IS: pulverulent mixture of G2 and G4 in a ratio of 1:1.

G7: 50% aqueous solution of tanning agent G5

G8: 40% aqueous solution of a mixture of G2 and G4 in a ratio of 1:1

Formulations of Component a)

Example A1

(using acetone to precipitate a solution prepared similarly to EP-A 0690135) (using 14.9% of emulsifier, based on HDI, bisulphite:NCO=1.092:1.0)

Unter nitrogen, 43.20 g (0.0192 mol) of an n-butanol-initiated ethylene oxide-propylene oxide polyether having a molecular weight of 2250 g/mol and an ethylene oxide group content of 85% (=Component c3) were dewatered at 120° C. and 50 mbar for 2 hours. Then, 290.2 g (1.7253 mmol) of hexamethylene diisocyanate were added at 60° C. under nitrogen and the reaction mixture heated to 100° C. It is subsequently stirred at 100° for one hour. NCO content determined (reckoned 43.2%, found 43.7%). 193.0 g of this reaction product were added dropwise to 857.0 g of sodium bisulphite solution (26.5% in water) at 25° C. during 30 minutes. The mixture is subsequently stirred at room temperature for 16 hours to obtain a clear colourless 40% strength solution of pH 4.8.

Then, 2100 ml of acetone are added. The mixture is additionally stirred for 2 hours while being cooled down to 15° C. The white precipitate which has come down is filtered off with suction, washed with acetone and dried in vacuo at 20° C. to constant weight (isolated yield: 87%, residual moisture content below 1%).

A 35% strength colourless solution of the product in water had a pH of 5.2.

Example A2

(using acetone to precipitate a solution prepared similarly to EP 1647563) (using 16.7% of emulsifier, based on HDI, 10 mol % excess bisulphite)

A solution of 57.4 g of a branched tridecyl alcohol ethoxylate with 10 mol of EO (=Component c3) in 2112.1 g of sodium bisulphite solution (22.1% in water) is admixed at room temperature with 344.2 g of hexamethylene diisocyanate added by metered addition during 2 hours under agitation. The temperature is allowed to rise to 50° C., the mixture is subsequently stirred at 45-50° C. for 2 hours and then cooled down to 25° C. A clear solution is obtained after 16 hours with a solids content of 34.2% and pH 5.92.

1000 g of this solution are admixed with 4000 ml of acetone at room temperature. The mixture is subsequently stirred for 30 minutes and the precipitated solid is filtered off with suction. The white precipitate is washed with acetone and dried in vacuo at 20° C. to constant weight (isolated yield 93.3%, residual moisture content below 1%).

A 35% strength colourless solution of the product in water had a pH of 5.80.

Following a storage time of 4 weeks at 40° C. and 60° C., the solid product was found to be unchanged in its IR, $^{1}H$ and $^{13}C$ NMR spectrum compared with the starting material before hot storage.

Example A3

(using 7.1% of emulsifier, based on HDI, molar ratio of bisulphite:NCO=1:1)

To a solution formed from 12.3 g of sorbitan polyethylene glycol (20) monododecanoate (e.g. Eumulgin SML 20 (Cognis) or Tween 20 (Croda) (=Component c1), which is alkoxylated with altogether 20 ethylene oxide units per sorbitan unit (HLB 16.7), in 266.2 g of water and 553.4 g of sodium bisulphite solution ($NaHSO_3$, 38-40% in water) are added at 20° C. 174.4 g of hexamethylene diisocyanate over 20 minutes under agitation and the temperature of the reaction mixture is raised to 50° C. The mixture is subsequently stirred at 50° C. for a further 1 hour, during which the reaction mixture turns clear. It is then cooled down to 23° C. over 2 hours. It is subsequently stirred at room temperature (20-23° C.) for a further 1 hour to obtain a clear solution having a solids content of 40.0% and a pH of 5.98.

This solution is admixed with 2000 ml of acetone at room temperature. The mixture is subsequently stirred for 2 hours while at the same time being cooled down to 15° C. The precipitated white solid is filtered off with suction, washed with acetone and dried in vacuo at 20° C. to a constant weight (isolated yield 95.7%, residual moisture content below 1%).

Concentration of bisulphite adduct (HPLC-MS): 97.7%.

The solution of the product in water at a concentration of 35% is clear, pH: 5.95.

The solution of 5 g of product in 50 ml of water had a pH of 6.15.

Following a storage time of 4 weeks at 40° C. and 60° C., the solid product was found to be unchanged in its IR, $^{1}H$ and $^{13}C$ NMR spectrum compared with the starting material before hot storage.

Example A4

(using 7.1% of emulsifier, based on HDI, $Na_2S_2O_5$, molar ratio of bisulphite:NCO=1:1)

To a solution formed from 32.6 g of sorbitan polyethylene glycol (20) monododecanoate (e.g. Eumulgin SML 20 (Cognis) or Tween 20 (Croda) (=Component c1), which is alkoxylated with altogether 20 ethylene oxide units per sorbitan unit (HLB 16.7), in 1648.3 g of water and 522.0 g of sodium disulphite ($Na_2S_2O_5$) are added at 20° C. 461.9 g of hexamethylene diisocyanate over 120 minutes under agitation and the temperature of the reaction mixture is raised to 50° C. The mixture is subsequently stirred at 50° C. for a further 1 hour, during which the reaction mixture turns clear. It is then cooled down to 25° C. over 2 hours to obtain a clear solution having a solids content of 38.9% and a pH of 6.32.

This solution is admixed with 5330 ml of acetone at room temperature. The mixture is subsequently stirred for 16 hours. The precipitated white solid is filtered off with suction, washed with acetone and dried in vacuo at 20 to 40° C. to a constant weight (isolated yield 87.8%, residual moisture content below 1%). Product can be secondarily precipitated from the filtrate by adding further acetone, so that a total yield of about 97% results.

Concentration of bisulphite adduct (HPLC-MS): 96.4% purity

A 35% strength colourless solution of the product in water had a pH of 5.4.

Following a storage time of 4 weeks at 40° C. and 60° C., the solid product was found to be unchanged in its IR, $^{1}H$ and $^{13}C$ NMR spectrum compared with the starting material before hot storage.

Example A5

(7.1% Of Comp. c), based on HDI, bisulphite:NCO=1.05:1)

To a solution formed from 9.9 g of lauryl alcohol ethoxylate, which is alkoxylated with 10 ethylene oxide units (HLB 13.8) (=Component c3), in 326.5 g of water and 461.7 g of sodium bisulphite solution ($NaHSO_3$, 38-40% in water) are added at 20° C. 138.6 g of hexamethylene diisocyanate in one portion under agitation. The temperature of the reaction mixture is then raised to 50° C. in the course of 60 minutes. At 50° C., 7.8 g of citric acid monohydrate dissolved in 7.8 g of water are added.

The mixture is subsequently stirred at 50° C. for 1 hour during which the reaction mixture turns clear. It is then cooled down to 23° C. over 2 hours. The pH of the solution is 4.36. Then, 23.6 g of citric acid monohydrate dissolved in 23.6 g of water are added and the concentration is adjusted by adding 20.0 g of water to obtain a clear 35.1% strength solution of pH 3.09.

This solution is admixed with 2000 ml of acetone at room temperature. The mixture is subsequently stirred for 2 hours while at the same time being cooled down to 15° C. The precipitated white solid is filtered off with suction, washed with acetone and dried in vacuo at 20° C. to a constant weight (isolated yield 91.7%, residual moisture content below 1%).

Example A6

(14.5% Of Comp. c), based on HDI, bisulphite:NCO=1.05:1)

To a solution formed from 9.9 g of lauryl alcohol ethoxylate, which is alkoxylated with 5 ethylene oxide units (HLB 10.5) (=Component c3), in 326.5 g of water and 461.7 g of sodium bisulphite solution ($NaHSO_3$, 38-40% in water) are added at 20° C. 138.6 g of hexamethylene diisocyanate in one portion under agitation. The temperature of the reaction mixture is then raised to 50° C. in the course of 60 minutes. At 50° C., 7.8 g of citric acid monohydrate dissolved in 7.8 g of water are added.

The reaction mixture is subsequently stirred at 50° C. for 15 minutes. Then, 9.9 g of lauryl alcohol ethoxylate alkoxylated with 30 ethylene oxide units (HLB 17.3) (=Component c3) are added and the reaction mixture is subsequently stirred at 50° C. for 30 minutes during which no clear reaction mixture is obtained. The pH of the solution is 5.25. Then, 7.8 g of citric acid monohydrate are added before subsequent stirring at 50° C. for 45 minutes. This is followed by cooling down to 23° C. over 2 hours before a pH of 4.12 is measured. Then, 23.6 g of citric acid monohydrate dissolved in 23.6 g of water are added and the concentration is adjusted by adding 20.0 g of water to obtain a cloudy 36.1% strength solution of pH 3.21.

This solution is admixed with 2000 ml of acetone at room temperature. The mixture is subsequently stirred for 1 hour. The precipitated white solid is filtered off with suction, washed with acetone and dried in vacuo at 20° C. to a constant weight (isolated yield 87%, residual moisture content below 1%).

Example A7

(7.1% Of Comp. c), based on HDI, bisulphite:NCO=1.05:1)

To a solution formed from 9.9 g of oleyl alcohol ethoxylate alkoxylated with 20 ethylene oxide units (HLB 15.0) (=Component c3) in 326.5 g of water and 461.7 g of sodium bisulphite solution ($NaHSO_3$, 38-40% in water) are added at 20° C. 138.6 g of hexamethylene diisocyanate in one portion under agitation. The temperature of the reaction mixture is then raised to 50° C. in the course of 40 minutes. On reaching 50° C., 7.8 g of citric acid monohydrate dissolved in 7.8 g of water are added.

This is followed by stirring at 50° C. for 1 hour to obtain a clear reaction mixture. This is followed by cooling down to 23° C. over 2 hours. The pH of the solution is 4.16. This is followed by the addition of 23.6 g of citric acid monohydrate dissolved in 23.6 g of water and adjustment of the concentration by adding 15.0 g of water to obtain a clear 35.0% strength solution of pH 2.94.

This solution is admixed with 2000 ml of acetone at room temperature. The mixture is subsequently stirred for 2 hours. The precipitated white solid is filtered off with suction, washed with acetone and dried in vacuo at 20° C. to a constant weight (isolated yield 90%, residual moisture content below 1%).

Example A8

(7.1% Of Comp. c), based on HDI, concentration: 40%, bisulphite:NCO=1.05:1)

To a solution formed from 97.9 g of sorbitan polyethylene glycol (20) monododecanoate (e.g. Eumulgin SML 20 (Cognis) or Tween 20 (Croda)), alkoxylated with altogether 20 ethylene oxide units per sorbitan unit (HLB 16.7) (=Component c1), in 2000 g of water and 4617.2 g of sodium bisulphite solution ($NaHSO_3$, 38-40% in water) are added at 25° C. and pH 4.14 1385.6 g of hexamethylene diisocyanate under agitation. The temperature of the reaction mixture is then adjusted to 50° C. over 35 minutes. The pH is 5.34. Then, 78.1 g of citric acid monohydrate dissolved in 64.7 g of water are added.

This is followed by stirring at 50° C. for 1 hour during which the reaction mixture turns clear. This is followed by cooling down to 25° C. over 2 hours. This is followed by stirring at room temperature (20-23° C.) for 1 hour. The pH of the solution is 3.85. Then, 235.7 g of citric acid monohydrate dissolved in 195.2 g of water are added and stirred in for 15 minutes. The concentration is adjusted by adding 70.0 g of water to obtain 8674.4 g of a clear 39.8% strength solution having a pH of 2.97.

This solution of the above-described compound containing carbamoylsulphonate groups is pumped at a metering rate of 89.2 ml per minute, using a peristaltic pump, into a spray dryer with nozzle atomizer at an air pressure setting of 2.5 to 3.0 bar. The inlet temperature of the spray dryer was set between 126 and 143° C. The outlet temperature was between 40 and 70° C. No caking in the dryer was observed. A white finely divided powder having a bulk density of 356 g per 1000 $cm^3$ was obtained with a dry residue of 82.26% (Mettler IR dryer HR 73 P, 120° C., standard drying, to constant weight). Then, the material obtained was dried at 40° C. and 50 mbar in a drying cabinet to constant weight. The drying residue is 99.13%. The low-dust product obtained had a particle size distribution from 0.1 μm to 150 μm and is very rapid to dissolve in water without clumping. A solution of 5 g of powder in 50 ml of water is clear and has a pH of 4.80.

Another spray dryer, with centrifugal atomizer, was operated at an inlet temperature of max. 130° C. and an outlet temperature of max. 80° C. and likewise produced, without redrying, a white product. The low-dust powder obtained had a particle size distribution from 5 μm to 200 μm, a residual moisture content of below 1% and is very rapid to dissolve in water without clumping.

The drying residue of the product was found to be 99.27% in this case (Mettler IR dryer HR 73 P. 120° C., standard drying, to constant weight). A solution of 5 g of powder in 50 ml of water is clear and has a pH of 4.94.

Example A9

(7.1% Of Comp. c), based on HDI, concentration: 35%, bisulphite:NCO=1.05:1)

To a solution formed from 42.6 g of sorbitan polyethylene glycol (20) monododecanoate (e.g. Eumulgin SML 20 (Cognis) or Tween 20 (Croda)), alkoxylated with altogether 20 ethylene oxide units per sorbitan unit (HLB 16.7) (=Component c1), in 1419.7 g of water and 2007.5 g of sodium bisulphite solution ($NaHSO_3$, 38-40% in water) are added at 25° C. and pH 3.84 602.4 g of hexamethylene diisocyanate under agitation. The temperature of the reaction mixture is then adjusted to 50° C. over 42 minutes. The pH is 5.04. Then, 34.0 g of citric acid monohydrate dissolved in 28.1 g of water are added.

This is followed by stirring at 50° C. for 1 hour during which the reaction mixture turns clear. This is followed by cooling down to 25° C. over 2 hours. This is followed by stirring at room temperature (20-23° C.) for 1 hour. The pH of the solution is 4.55. Then, 102.5 g of citric acid monohydrate dissolved in 84.9 g of water are added and stirred in for 15 minutes. The concentration is adjusted by adding 70.0 g of water to obtain 4391.7 g of a clear 35% strength solution having a pH of 2.96.

For dustproofing, 12.3 g of a polyether obtained by alkoxylation of 1,4-bis(2-hydroxyethoxy)benzene with 1 to 2 mol of ethylene oxide and then with 6 mol of propylene oxide were dissolved in 3500 g of the above-described aqueous solution of the compound containing carbamoylsulphonate groups, and the mixture is pumped at a metering rate of 97.8 ml per minute, using a peristaltic pump, into a spray dryer with nozzle atomizer at an air pressure setting of 3.0 bar. The inlet temperature of the spray dryer was set between 129 and 133° C. The outlet temperature was between 45 and 70° C. No caking in the dryer was observed. A white finely divided powder having a bulk density of 370 g per 1000 mL was obtained with a dry residue of 93.46% (Mettler IR dryer HR 73 P, 120° C., standard drying, to constant weight). Then, the material obtained was dried at 40° C. and 50 mbar in a drying cabinet to constant weight (residual moisture less than 1%). The low-dust product obtained had a particle size distribution from 1 μm to 300 μm and is very rapid to dissolve in water without clumping. A solution of 5 g of powder in 50 ml of water had a pH of 4.13.

Example A10

(7.1% Of Comp. c), based on HDI, concentration: 35%, bisulphite:NCO=1.05:1)

To a solution formed from 49.0 g of sorbitan polyethylene glycol (20) monododecanoate (e.g. Eumulgin SML 20 (Cognis) or Tween 20 (Croda)), alkoxylated with altogether 20 ethylene oxide units per sorbitan unit (HLB 16.7) (=Component c1), in 1632.7 g of water and 2308.6 g of sodium bisulphite solution ($NaHSO_3$, 38-40% in water) are added at 25° C. and pH 3.93 692.8 g of hexamethylene diisocyanate under agitation. The temperature of the reaction mixture is then adjusted to 50° C. over 42 minutes. The pH is 5.28. Then, 39.1 g of citric acid monohydrate dissolved in 32.4 of water are added.

This is followed by stirring at 50° C. for 1 hour during which the reaction mixture turns clear. This is followed by cooling down to 25° C. over 2 hours. This is followed by stirring at room temperature (20-23° C.) for 1 hour. The pH of the solution is 4.60. Then, 117.9 g of citric acid monohydrate dissolved in 97.6 g of water are added and stirred in for 15 minutes. The concentration is adjusted by adding 50.0 g of water to obtain 4980.7 g of a clear 34.92% strength solution having a pH of 3.06.

3500 g of this solution of the above-described compound containing carbamoylsulphonate groups were stirred up with 12.3 g of a water-dispersible dustproofing agent based on mineral oil, and the mixture is pumped at a metering rate of 114.2 ml per minute, using a peristaltic pump, into a spray dryer with nozzle atomizer at an air pressure setting of 3.0 bar. The inlet temperature of the spray dryer was set between 130 and 133° C. The outlet temperature was between 50 and 89° C. No caking in the dryer was observed. A white finely divided powder having a bulk density of 380 g per 1000 mL was obtained with a dry residue of 97.60% (Mettler IR dryer HR 73 P, 120° C., standard drying, to constant weight). Then, the material obtained was dried at 40° C. and 50 mbar in a drying cabinet to constant weight (residual moisture less than 1%). The low-dust product obtained had a particle size distribution from 1 μm to 250 μm and is very rapid to dissolve in water without clumping. A solution of 5 g of powder in 50 ml of water had a pH of 4.14.

Example A11

(using 7.1% of emulsifier, based on diisocyanate, molar ratio of bisulphite:NCO=1:1)

To a solution formed from 17.2 g of sorbitan polyethylene glycol (20) monododecanoate (e.g. Eumulgin SML 20 (Cognis) or Tween 20 (Croda)), which is alkoxylated with altogether 20 ethylene oxide units per sorbitan unit (HLB 16.7) (=Component c1), in 441.7 g of water and 800.0 g of sodium bisulphite solution ($NaHSO_3$, 38-40% in water) are added at 20° C. 290.7 g of bis(isocyanatomethyl)cyclohexane (isomer mixture, predominantly 1,4-Isomer) under agitation and the temperature of the reaction mixture is raised to 50° C. over 60 minutes. The mixture is subsequently stirred at 50° C. for a further 1 hour, during which the reaction mixture turns clear. It is then cooled down to 23° C. over 2 hours. It is subsequently stirred at room temperature (20-23° C.) for a further 1 hour to obtain a clear solution having a solids content of 40.0% and a pH of 5.93.

This solution is admixed with 3000 ml of acetone at room temperature. The mixture is subsequently stirred for 2 hours while at the same time being cooled down to 17° C. The precipitated white solid is filtered off with suction, washed with acetone and dried in vacuo at 20° C. to a constant weight (isolated yield 63.7%, residual moisture content below 1%).

Example A12

(using 7.1% of emulsifier, based on diisocyanate, molar ratio bisulphite:NCO=1.05:1)

To a solution formed from 19.8 g of sorbitan polyethylene glycol (20) monododecanoate (e.g. Eumulgin SML 20 (Cognis) or Tween 20 (Croda)), which is alkoxylated with altogether 20 ethylene oxide units per sorbitan unit (HLB 16.7) (=Component c1), in 653.0 g of water and 923.4 g of sodium bisulphite solution ($NaHSO_3$, 38-40% in water) are added at 20° C. 320.2 g of bis(isocyanatomethyl)cyclohexane (isomer mixture, predominantly 1,3-Isomer) under agitation and the temperature of the reaction mixture is raised to 50° C. over 70 minutes. The pH is 5.08. A solution of 15.6 g of citric acid monohydrate in 15.6 g of water is added followed by stirring at 50° C. for 1.5 hours during which the reaction mixture turns clear. This is followed by cooling down to 23° C. in the course of 2 hours. This is followed by stirring at room temperature (20-23° C.) for 1 hour. The pH is 4.78. Then, 47.2 g of citric acid dissolved in 47.2 g of water are added followed by stirring for 15 minutes. To adjust the concentration, 122.4 g of water are added to obtain a clear solution having a solids content of 35.1% and a pH of 2.95.

The solution is dried at 20° C., then at 40-50° C. and 50 mbar in a drying cabinet to constant weight. An isolated yield of 720.1 g of a white solid is obtained. The drying residue of the product was found to be 99.7% (Mettler IR dryer HR 73 P, 120° C., standard drying, to constant weight, residual moisture content below 1%). A solution of 17.5 g of powder in 50 ml of water is clear and has a pH of 2.97.

Example A13

(7.1% Of Comp. c), based on HDI, metered addition of HDI at 80° C., bisulphite:NCO=1.05:1)

To a solution of 5.9 g of sorbitan polyethylene glycol (20) monododecanoate (e.g. Eumulgin SML 20 (Cognis) or Tween 20 (Croda)), alkoxylated with altogether 20 ethylene oxide units per sorbitan unit (HLB 16.7) (=Component c1), in 195.9 g of water and 277.0 g of sodium bisulphite solution ($NaHSO_3$, 38-40% in water) are added at 80° C. 83.1 g of hexamethylene diisocyanate in one portion under agitation, followed by cooling. After 5 minutes a temperature of 85° C. is reached. Then, 4.7 g of citric acid monohydrate dissolved in 3.9 g of water are added, at which point the pH of the reaction mixture is 5.77. After a further 5 minutes a temperature of 90° C. is reached (pH 5.83). Then, the batch is cooled down to 25° C. over 75 minutes, and a clear solution forms during the cooling phase. The pH of the solution is 6.29 at room temperature. This is followed by the addition of 18.8 g of citric acid monohydrate dissolved in 16.4 g of water and adjustment of the concentration by addition of 33.0 g of water to obtain a clear 34.0% strength solution of pH 3.09.

This solution is admixed with 1500 ml of acetone at room temperature. The mixture is subsequently stirred for 2 hours. The precipitated white solid is filtered off with suction, washed with acetone and dried in vacuo at 20° C. to a constant weight (isolated yield 87%, residual moisture content below 1%).

Example A14

(7.1% Of Comp. c), based on HDI, metered addition of HDI at 60° C., bisulphite:NCO=1.05:1)

To a solution of 5.9 g of sorbitan polyethylene glycol (20) monododecanoate (e.g. Eumulgin SML 20 (Cognis) or Tween 20 (Croda)), alkoxylated with altogether 20 ethylene oxide units per sorbitan unit (HLB 16.7) (=Component c1), in 195.9 g of water and 277.0 g of sodium bisulphite solution ($NaHSO_3$, 38-40% in water) are added at 60° C. 83.1 g of hexamethylene diisocyanate in one portion under agitation, followed by cooling. After 8 minutes a temperature of 70° C. is reached. Then, 4.7 g of citric acid monohydrate dissolved in 3.9 g of water are added, at which point the pH of the reaction mixture is 4.90. This is followed by stirring at 70° C. for a further 20 minutes to form an almost clear solution. The batch is then cooled down to 25° C. over 60 minutes. The pH of the clear solution is 5.38 at room temperature. This is followed by the addition of 14.1 g of citric acid monohydrate dissolved in 11.7 g of water and adjustment of the concentration by addition of 4.8 g of water to obtain a clear 34.7% strength solution of pH 3.30.

This solution is admixed with 1500 ml of acetone at room temperature. The mixture is subsequently stirred for 2 hours. The precipitated white solid is filtered off with suction, washed with acetone and dried in vacuo at 20° C. to a constant weight (isolated yield 90%, residual moisture content below 1%).

Example A15

(7.1% Of Comp. c), based on HDI, metered addition of HDI at 50° C., bisulphite:NCO=1.05:1)

To a solution of 5.9 g of sorbitan polyethylene glycol (20) monododecanoate (e.g. Eumulgin SML 20 (Cognis) or Tween 20 (Croda)), alkoxylated with altogether 20 ethylene oxide units per sorbitan unit (HLB 16.7) Component c1), in 195.9 g of water and 277.0 g of sodium bisulphite solution ($NaHSO_3$, 38-40% in water) are added at 50° C. 83.1 g of hexamethylene diisocyanate in one portion under agitation, followed by cooling. After 8 minutes a temperature of 63° C. is reached. Then, 4.7 g of citric acid monohydrate dissolved in 3.9 g of water are added, at which point the pH of the reaction mixture is 3.79. This is followed by stirring at 60° C. for a further 1 hour, to form a clear solution after just 15 minutes. The batch is then cooled down to 25° C. over 60 minutes. The pH of the clear solution is 4.61 at room temperature. This is followed by the addition of 14.1 g of citric acid monohydrate dissolved in 11.7 g of water to obtain a clear 35.5% strength solution of pH 2.88. This solution is admixed with 1500 ml of acetone at room temperature. The mixture is subsequently stirred for 2 hours. The precipitated white solid is filtered off with suction, washed with acetone and dried in vacuo at 20° C. to a constant weight (isolated yield 88.5%, residual moisture content below 1%).

Example A16

A modular microreaction system from Ehrfeld BTS GmbH is used. On a base plate, the following essential modules (material: hastelloy) are mounted close together: 2 inlet modules, 2 pressure sensors, 1 cascade mixer, 1 heat exchanger, 1 temperature sensor, 1 overpressure valve, 1 isolating module, 1 sandwich reactor, 1 isolating module, 1 heat exchanger for cooling, 1 temperature sensor, 1 flow meter, 1 outlet module.

A solution is prepared from 59 g of sorbitan polyethylene glycol (20) monododecanoate (e.g. Eumulgin SML 20 (Cognis) or Tween 20 (Croda)), alkoxylated with altogether 20 ethylene oxide units per sorbitan unit (HLB 16.7) (=Component c1), 1959 g of water and 2770 g of sodium bisulphite solution ($NaHSO_3$, freshly prepared, 39% in water) and filled into a stock reservoir container. A second stock reservoir container supplies 831 g of hexamethylene diisocyanate which are initially charged.

Microtoothed ring pumps are used to effect the metered addition into the system. The corresponding volume flows are determined. After the plant has been readied, the two components are pumped continuously and simultaneously in a stoichiometric ratio of 1.00 mol of bisulphite per 1.00 mol of NCO via inlet modules into the micromixer of the plant, while thermostats are used to set the 1st heat exchanger to 50° C., the reactor to 70° C. and to cool the 2nd heat exchanger with water. The metering rate of the two components was adjusted such that the reaction mixture leaves the reaction system as a 35% strength aqueous solution at a rate of 50 ml/minute. The mixture was already almost clear and had a pH of 3.90. The concentration of the compound containing carbamoylsulphonate groups was determined, via HPLC, on samples taken directly at the outlet module. The concentration was found to be 32.5%. Following a post-reaction stir time of 15 minutes in a delay tank at 20-23° C. a clear solution forms. A sample taken from the delay tank had a concentration of 34% in respect of the compound containing carbamoylsulphonate groups. The pH of the clear solution is 3.95.

A 100 ml sample of the solution obtained is mixed with 300 ml of acetone at room temperature. This is followed by stirring for 5 minutes. The precipitated white solid is filtered off with suction, washed with acetone and dried in vacuo at 20° C. to a constant weight (isolated yield 90.5%, residual moisture content below 1%).

The remaining solution from the delay tank is maintained at pH 3.00 with citric acid and is continuously metered into a spray dryer with nozzle atomizer similar to Example A8 and continuously dried at an inlet temperature of 140° C. and an outlet temperature of 80° C. to obtain a white powder having a residual moisture content of 1.2%.

Example A17

(7.1% Of Comp. c), based on HDI)

To a solution formed from 21 g of sorbitan polyethylene glycol (20) monododecanoate (e.g. Eumulgin® SML 20 (Cognis) or Tween® 20 (Croda)), alkoxylated with altogether 20 ethylene oxide units per sorbitan unit (HLB 16.7), in 1334 g of water and 351.6 g of sodium metabisulphite ($Na_2S_2O_5$) are added at 23° C. 296.4 g of hexamethylene diisocyanate in one portion under agitation.

The temperature of the reaction mixture is then raised to 50° C. over 30 minutes. At this stage, the mixture has reached a pH of 5.53.

The mixture is subsequently stirred at 50° C. for 1 hour during which the pH rises to 6.51 in the first 30 minutes and then remains constant. The reaction mixture is almost clear and is cooled down to 20° C. in the course of 2 hours. This is followed by stirring at room temperature (20-23° C.) for 2 hours. The pH of the solution is 6.39.

The batch is then divided:

1) 961.4 g of product are admixed with 8.1 g of citric acid monohydrate (0.8%).

Filtration gives a clear solution of 34.8% solids content and pH 3.60.

2) 1024.9 g of product are admixed with 25.4 g of citric acid monohydrate (2.4%).

Filtration gives a clear solution of 36.1% solids content and pH 2.96.

Example A18

(7.1% Of Comp. c), based on HDI)

A solution formed from 2668 g of water and 703.2 g of sodium metabisulphite ($Na_2S_2O_5$) was used to dissolve 42.0 g of sorbitan polyethylene glycol (20) monododecanoate (e.g. Eumulgin® SML 20 (Cognis) or Tween® 20 (Croda)), alkoxylated with altogether 20 ethylene oxide units per sorbitan unit (HLB 16.7) (=Component c1). At 22° C., 592.8 g of hexamethylene diisocyanate were added in one portion under agitation. The temperature of the reaction mixture is then raised to 50° C. over 40 minutes. At this stage, the mixture has reached a pH of 5.72.

This is followed by the addition of 33.6 g of citric acid monohydrate dissolved in 100 g of water, resulting in a pH of 3.72.

This is followed by stirring at 50° C. for 1 hour, in which the pH rises to 4.66 in the first 30 minutes and then remains constant. The reaction mixture is already clear and is cooled down to 20° C. over 2 hours. This is followed by stirring at room temperature (20-23° C.) for 2 hours. The pH of the solution is 4.67. This is followed by the addition of 100.8 g of citric acid monohydrate in solid form and adjustment of the concentration with water to obtain a clear 35% strength solution of pH 3.11.

Example A19

(6.1% Of Comp. c), based on IPDI)

To a solution of 15.7 of sorbitan polyethylene glycol (20) monododecanoate (e.g. Eumulgin® SML 20 (Cognis) or Tween® 20 (Croda)), alkoxylated with altogether 20 ethylene oxide units per sorbitan unit (HLB 16.7) (=Component c1) in 573.1 g of water and 646.4 g of sodium bisulphite solution ($NaHSO_3$, 38-40% in water) are added at 20° C. 256.4 g of isophorone diisocyanate over 5 minutes under agitation. The temperature of the reaction mixture is then raised to 50° C. over 90 minutes. At this stage, the mixture has reached a pH of 5.90.

This is followed by stirring at 50° C. for 1.5 hours during which the reaction mixture turns clear after 45 minutes. This is followed by cooling down to 23° C. over 1.5 hours. This is followed by stirring at room temperature (20-23° C.) for 4 hours. The pH of the solution is 5.65. This is followed by the addition of 20.4 g of citric acid monohydrate dissolved in 20.4 g of water and adjustment of the concentration with 18.7 g of water to obtain a clear 35% strength solution with pH 2.80.

Example A20

(7.1% Of Comp. c), based on HDI)

To a solution of 97.9 g of sorbitan polyethylene glycol (20) monododecanoate (e.g. Eumulgin®SML 20 (Cognis) or Tween® 20 (Croda)), alkoxylated with altogether 20 ethylene oxide units per sorbitan unit (HLB 16.7) (=Component c1) in 3265.3 g of water and 4617.2 g of sodium bisulphite solution ($NaHSO_3$, 38-40% in water are added at 20° C. 1385.6 g of hexamethylene diisocyanate over 5 minutes under agitation. The temperature of the reaction mixture is then raised to 50° C. over 30 minutes. Then 78.1 g of citric acid monohydrate are dissolved in 64.7 g of water.

This is followed by stirring at 50° C. for 1 hour during which the reaction mixture turns clear. This is followed by cooling down to 23° C. over 2 hours. This is followed by stirring at room temperature (20-23° C.) for 1 hour. The pH of the solution is 3.84. This is followed by the addition of 235.7 g of citric acid monohydrate dissolved in 195.2 g of water and adjustment of the concentration with 264.2 g of water to obtain a clear 35.2% strength solution with pH 2.68.

Example A21

(7.1% Of Comp. c), based on HDI)

To a solution of 10.5 g of sorbitan polyethylene glycol (20) monododecanoate (e.g. Eumulgin SML 20 (Cognis) or Tween 20 (Croda)), alkoxylated with altogether 20 ethylene oxide units per sorbitan unit (HLB 16.7) (=Component c 1), in 550.0 g of water and 184.2 g of sodium metabisulphite ($Na_2S_2O_5$) are added 1.2 g of citric acid monohydrate. Then, at 23° C., 148.2 g of hexamethylene diisocyanate are added in one portion under agitation. Immediately thereafter, a solution of 58.3 g of citric acid monohydrate dissolved in 99.2 g of water is added to obtain a pH between 3.0 and 4.0. Directly following addition of the isocyanate, the temperature of the reaction mixture is at the same time raised to 50° C. in the course of 50 minutes. The reaction mixture is subsequently stirred at 50° C. for 1 hour. The reaction mixture turns clear and has a pH of 3.55. Finally, 169.0 g of water are added to obtain a clear 33.7% strength solution of pH 3.24.

Example A22

(7.14% Of Comp. c), based on HDI)

To a solution of 9.9 g of sorbitan polyethylene glycol (20) monoleate (e.g. Tween 80, Croda), alkoxylated with altogether 20 ethylene oxide units per sorbitan unit (HLB 15.0) (=Component c1), in 326.5 g of water and 461.7 g of sodium bisulphite solution ($NaHSO_3$, 38-40% in water) are added at 24° C. 138.6 g of hexamethylene diisocyanate in one portion under agitation. The temperature of the reaction mixture is then raised to 50° C. over 30 minutes. At this stage, the mixture has reached a pH of 5.23.

This is followed by the addition of 7.8 g of citric acid monohydrate dissolved in 7.8 g of water, resulting in a pH of 3.45. This is followed by stirring at 50° C. for 1 hour during which the pH rises to 4.28 in the first 30 minutes and then remains constant. The reaction mixture is clear and is cooled down to 20° C. over 2 hours. This is followed by stirring at room temperature (20-23° C.) for 2 hours. The pH of the solution is 4.14. This is followed by the addition of 23.6 g of citric acid monohydrate dissolved in 23.6 g of water and adjustment of the concentration with 20.0 g of water to obtain a clear 35% strength solution of pH 3.05.

Example A23

(7.14% Of Comp. c), based on HDI)

To a solution of 9.9 g of sorbitan polyethylene glycol (20) monohexadecanoate (e.g. Tween 40, Croda), alkoxylated with altogether 20 ethylene oxide units per sorbitan unit (HLB 15.6) (=Component c1), in 326.5 g of water and 461.7 g of sodium bisulphite solution ($NaHSO_3$, 38-40% in water) are added at 21° C. 138.6 g of hexamethylene diisocyanate in one portion under agitation. The temperature of the reaction mixture is then raised to 50° C. over 40 minutes. At this stage, the mixture has reached a pH of 5.51.

This is followed by the addition of 7.8 g of citric acid monohydrate dissolved in 7.8 g of water, resulting in a pH of 3.56.

This is followed by stirring at 50° C. for 1 hour during which the pH rises to 4.35 in the first 30 minutes and then remains constant. The reaction mixture is clear and is cooled down to 20° C. over 2 hours. This is followed by stirring at room temperature (20-23° C.) for 2 hours. The pH of the solution is 4.25. This is followed by the addition of 23.6 g of citric acid monohydrate dissolved in 23.6 g of water and adjustment of the concentration with 20.0 g of water to obtain a clear 34.9% strength solution of pH 2.58.

Example A24

(6.18% Of Comp. c), based on diisocyanate)

To a solution of 9.9 g of sorbitan polyethylene glycol (20) monododecanoate (e.g. Eumulgin® SML 20 (Cognis) or Tween® 20 (Croda)), alkoxylated with altogether 20 ethylene oxide units per sorbitan unit (HLB 16.7) (=Component c1) in 326.5 g of water and 461.7 g of sodium bisulphite solution ($NaHSO_3$, 38-40% in water) are added at 20° C. 160.1 g of 1,3-bis(isocyanatomethyl)cyclohexane (Aldrich) under agitation. The temperature of the reaction mixture is then raised to 50° C. over 30 minutes. At this stage, the mixture has reached a pH of 3.97.

This is followed by the addition of 7.8 g of citric acid monohydrate dissolved in 7.8 g of water, resulting in a pH of 3.23. This is followed by stirring at 50° C. for 1.75 hours during which the pH rises to 4.29 in the first 60 minutes and then remains constant. The reaction mixture is clear and is cooled down to 20° C. over 2 hours. This is followed by stirring at room temperature (20-23° C.) for 2 hours. The pH of the solution is 4.07. This is followed by the addition of 23.6 g of citric acid monohydrate dissolved in 23.6 g of water and adjustment of the concentration with 61.2 g of water to obtain a clear 35.0% strength solution of pH 2.60.

Example A25

(7.07% Of Comp. c), based on HDI)

To a solution of 9.8 g of sorbitan polyethylene glycol (20) monooctadecanoate (e.g. Eumulgin® SML 20 (Cognis) or Tween60 (Croda)), alkoxylated with altogether 20 ethylene oxide units per sorbitan unit (HLB 14.9) (=Component c1) in 326.5 g of water and 461.7 g of sodium bisulphite solution ($NaHSO_3$, 38-40% in water) are added at 24° C. 138.6 g of hexamethylene diisocyanate under agitation. The temperature of the reaction mixture is then raised to 50° C. over 28 minutes. At this stage, the mixture has reached a pH of 5.28.

This is followed by the addition of 7.8 g of citric acid monohydrate dissolved in 6.5 g of water, resulting in a pH of 3.11. This is followed by stirring at 50° C. for 1 hour during which the pH rises to 3.22 in the first 30 minutes and then remains constant. The reaction mixture is almost clear and is cooled down to 20° C. over 2 hours. This is followed by stirring at room temperature (20-23° C.) for 2 hours. The pH of the solution is 2.80. This is followed by the addition of 23.6 g of citric acid monohydrate dissolved in 23.6 g of water and adjustment of the concentration with 20.0 g of water to obtain a slightly cloudy 34.9% strength solution of pH 2.38.

Example A26

(7.12% Of Comp. c), based on HDI)

To a solution of 15.8 g of C8-C10 alkylglucoside (DP 1.6) (62.5% in water) (e.g. Glucopon 215 UP, Cognis) (=Component c2), in 320 g of water and 461.7 g of sodium bisulphite solution ($NaHSO_3$, 38-40% in water) are added at 22° C. 138.6 g of hexamethylene diisocyanate in one portion under agitation. The temperature of the reaction mixture is then raised to 50° C. during 45 minutes. At this point, the mixture has reached a pH of 5.27.

This is followed by the addition of 7.8 of citric acid monohydrate dissolved in 7.8 g of water resulting in a pH of 3.86.

This is followed by stirring at 50° C. for 1 hour during which the pH rises to 4.95. The reaction mixture is already clear and is cooled down to 20° C. during 2 hours. This is followed by stirring at room temperature (20-23° C.) for 2 hours. The pH of the solution is 4.84. This is followed by the addition of 45.8 g of citric acid monohydrate dissolved in 45.8 g of water and adjustment of the concentration with 21.8 g of water to obtain a clear 35.6% strength solution of pH 2.80.

Example A27

(7.14% Of Comp. c), based on HDI)

To a solution of 19.4 g of C12-C16 alkylglucoside (DP 1.4) (51% in water) (e.g. Glucopon 600 CS UP, Cognis) (=Component c2), in 317 g of water and 461.7 g of sodium bisulphite solution ($NaHSO_3$, 38-40% in water) are added at 22° C. 138.6 g of hexamethylene diisocyanate in one portion under agitation. The temperature of the reaction mixture is then raised to 50° C. during 55 minutes. At this point, the mixture has reached a pH of 5.04.

This is followed by the addition of 7.8 g of citric acid monohydrate dissolved in 7.8 g of water resulting in a pH of 3.87.

This is followed by stirring at 50° C. for 1 hour during which the pH rises to 5.04. The reaction mixture is almost clear and is cooled down to 20° C. during 2 hours. This is followed by stirring at room temperature (20-23° C.) for 2 hours. The pH of the solution is 5.01. This is followed by the addition of 30.4 g of citric acid monohydrate dissolved in 23.6 g of water and adjustment of the concentration with 6.8 g of water to obtain a transparent, almost clear 35.4% strength solution of pH 3.07.

Example A28

(7.14% Of Comp. c), based on HDI)

To a solution of 9.9 g of hydrogenated castor oil ethoxylate (e.g. Eumulgin HRE 40, Cognis), which is alkoxylated with altogether 40 ethylene oxide units (HLB 14.0) (=Component c1), in 326.5 g of water and 461.7 g of sodium bisulphite solution ($NaHSO_3$, 38-40% in water) are added at 20° C. 138.6 g of hexamethylene diisocyanate in one portion under agitation. The temperature of the reaction mixture is then raised to 50° C. during 45 minutes. At this point, the mixture has reached a pH of 6.01.

This is followed by the addition of 7.8 g of citric acid monohydrate dissolved in 7.8 g of water resulting in a pH of 3.80.

This is followed by stirring at 50° C. for 1 hour during which the pH rises to 4.30. The reaction mixture is clear and is cooled down to 20° C. during 2 hours. This is followed by stirring at room temperature (20-23° C.) for 2 hours. The pH of the solution is 4.18. This is followed by the addition of 23.6 g of citric acid monohydrate dissolved in 23.6 g of water and adjustment of the concentration with 15.0 g of water to obtain a clear 35.0% strength solution of pH 3.02.

Example A29

(7.1% Of Comp. c), based on HDI)

To a solution of 9.9 g of polyoxyethylene (20) glycerol monostearate (e.g. Cutina® E24, Cognis), which is alkoxylated with altogether 20 ethylene oxide units per glycerol unit (HLB 13.5) (Component c1), in 326.5 g of water and 461.7 g of sodium bisulphite solution ($NaHSO_3$, 38-40% in water) are added at 22° C. 138.6 g of hexamethylene diisocyanate in one portion under agitation. The temperature of the reaction mixture is then raised to 50° C. during 40 minutes. At this point, the mixture has reached a pH of 5.67.

This is followed by the addition of 7.8 g of citric acid monohydrate dissolved in 7.8 g of water resulting in a pH of 3.80.

This is followed by stirring at 50° C. for 1 hour during which the pH rises to 4.79. The reaction mixture is clear and is cooled down to 20° C. during 2 hours. This is followed by stirring at room temperature (20-23° C.) for 2 hours. The pH of the solution is 4.69. This is followed by the addition of 33.6 g of citric acid monohydrate dissolved in 33.6 g of water and adjustment of the concentration with 15.0 g of water to obtain a transparent, almost clear 35.2% strength solution of pH 2.82.

Example A30

(7.1% Of Comp. c), based on HDI)

To a solution of 9.8 g of sorbitan polyethylene glycol (30) monododecanoate, which is alkoxylated with altogether 30 ethylene oxide units per sorbitan unit (HLB 17.6) (=Component c1), in 326.5 g of water and 461.7 g of sodium bisulphite solution ($NaHSO_3$, 38-40% in water) are added at 20° C. 138.6 g of hexamethylene diisocyanate under agitation for 5 minutes. The temperature of the reaction mixture is then raised to 50° C. during 30 minutes. Then 7.8 g of citric acid monohydrate dissolved in 6.5 g of water are added.

This is followed by stirring at 50° C. for 1 hour during which the reaction mixture clarifies. It is then cooled down to 23° C. during 2 hours. This is followed by stirring at room temperature (20-23° C.) for 1 hour. The pH of the solution is 3.91. This is followed by the addition of 23.6 g of citric acid monohydrate dissolved in 19.5 g of water and adjustment of the concentration by addition of 26.4 g of water to obtain a clear 35.2% strength solution of pH 2.75.

Example A31

(7.1% Of Comp. c), based on HDI)

To a solution of 9.8 g of sorbitan polyethylene glycol (15) monododecanoate, which is alkoxylated with altogether 15 ethylene oxide units per sorbitan unit (HLB 16.0) (=Component c1), in 326.5 g of water and 461.7 g of sodium bisulphite solution ($NaHSO_3$, 38-40% in water) are added at 20° C. 138.6 g of hexamethylene diisocyanate under agitation for 5 minutes. The temperature of the reaction mixture is then raised to 50° C. during 30 minutes. Then 7.8 g of citric acid monohydrate dissolved in 6.5 g of water are added.

This is followed by stirring at 50° C. for 1 hour during which the reaction clarifies. It is then cooled down to 23° C. during 2 hours. This is followed by stirring at room temperature (20-23° C.) for 1 hour. The pH of the solution is 3.85. This is followed by the addition of 23.6 g of citric acid monohydrate dissolved in 19.5 g of water and adjustment of the concentration by addition of 26.4 g of water to obtain a clear 35.2% strength solution of pH 2.80.

Example A32

(7.1% Of Comp. c), based on HDI)

A solution of 1334.0 g of water and 351.6 g of sodium metabisulphite ($Na_2S_2O_5$) was used to dissolve 21.0 g of sorbitan polyethylene glycol (20) monododecanoate (e.g. Eumulgin SML 20 (Cognis) or Tween 20 (Croda)), which is alkoxylated with altogether 20 ethylene oxide units per sorbitan unit (HLB 16.7) (=Component c1). At 40° C., 296.4 g of hexamethylene diisocyanate were added in one portion under agitation. After 10 minutes a temperature of 50° C. is reached. At this point, the mixture has reached a pH of 4.89. The mixture is subsequently stirred at 50° C. for 1 hour during which the pH rises to 6.30 within 20 minutes and then remains constant. The reaction mixture is slightly cloudy and is cooled down to 20° C. during 2 hours. It is subsequently stirred at room temperature (20-23° C.) for 2 hours. The pH of the solution is 6.12. This is followed by the addition of 48.1 g of citric acid monohydrate in solid form and adjustment of the concentration with water. After filtration a clear 35% strength solution of pH 2.95 is obtained.

Example A33

(17.4% Of Comp. c), based on HDI)

A solution of 3700.0 g of water and 1013.1 g of sodium metabisulphite ($Na_2S_2O_5$) was used to dissolve 142.0 g of sorbitan polyethylene glycol (20) monododecanoate (e.g. Eumulgin SML 20 (Cognis) or Tween 20 (Croda)), which is alkoxylated with altogether 20 ethylene oxide units per sorbitan unit (HLB 16.7) (=Component c1). Starting at 22° C., 815.3 g of hexamethylene diisocyanate were added during 2 hours under agitation. After a further 30 minutes the mixture has reached a pH of 5.77 and 32° C. This is followed by 5.5 hours of stirring with slight cooling at a temperature at 20 to 30° C., during which the pH drops to 5.68. The reaction mixture is cloudy and is left to stand overnight. The still slightly cloudy solution is admixed with 46.2 g of citric acid monohydrate and 300 g of water. Filtration gives a clear 34.5% strength solution of pH 3.35.

Inventive Solid Particulate Tanning Agent Mixtures Containing Compounds Containing Carbamoylsulphonate Groups Example AG 1

535.7 g of tanning agent G6 and 500.0 g of the product of Example A3 are thoroughly ground in a mill to obtain 1035.7 g of a white powder.

A solution of 5 g of this powder in 50 ml water has a pH of 6.58.

Example AG 2

35.7 g of tanning agent G2 and 17.9 g of tanning agent G4 are initially charged. At room temperature, 142.9 g of the product of Example A20 (35% strength) are added and mixed in a mill until homogeneous. The mixture is dried at 50 mbar and 20-40° C. in a drying cabinet to constant weight to obtain 94.3 g of a white powder.

A solution of 5 g of this powder in 50 ml of water has a pH of 3.55.

Example AG 3

1764.6 g of tanning agent G1 and 1235.3 g of the product of Example A8 are thoroughly ground in a mill to obtain about 3000 g of an almost white powder.

A solution of 5 g of this powder in 50 ml water has a pH of 3.36.

Example AG 4

(7.1% Of Comp. c) based on HDI)

To a solution formed from 42.6 g of sorbitan polyethylene glycol (20) monododecanoate (e.g. Eumulgin SML 20 (Cognis) or Tween 20 (Croda)), alkoxylated with altogether 20 ethylene oxide units per sorbitan unit (HLB 16.7), in 1419.7 g of water and 2007.5 g of sodium bisulphite solution ($NaHSO_3$, 38-40% in water) are added at 20° C. 602.4 g of hexamethylene diisocyanate under agitation for 5 minutes. The temperature of the reaction mixture is then increased to 50° C. over 42 minutes. The pH is 5.04. Then, 34.0 g of citric acid monohydrate dissolved in 28.1 g of water are added.

This is followed by stirring at 50° C. for 1 hour during which the reaction mixture turns clear. This is followed by cooling down to 23° C. over 2 hours. This is followed by stirring at room temperature (20-23° C.) for 1 hour. The pH of the solution is 4.55. Then, 102.5 g of citric acid monohydrate dissolved in 84.9 g of water are added and stirred in for 15 minutes. The concentration is adjusted by adding 70.0 g of water to obtain a clear 34.9% strength solution having a pH of 2.97.

Then, 1457.6 g of the solution of the above-described compound containing carbamoylsulphonate groups are taken and stirred up with a mixture prepared beforehand by dissolving 364.5 g of tanning agent G2 (Tanigan BN) and 182.2 g of tanning agent G4 (Tanigan PR) in 820.0 g of water at 60° C. and cooling down to 22° C. and having a pH of 3.56. This gives a finely divided suspension having a pH of 3.19 and a solids content of 37.0%, which is pumped at a metering rate of 39.4 ml per minute, by means of a peristaltic pump, into a spray dryer with nozzle atomizer while the air pressure at the nozzle was 3 bar. The inlet temperature of the spray dryer was set to 130° C. The outlet temperature was between 69 and 75° C. This gave a light-coloured finely divided powder having a bulk density of 560 g per 1000 mL, which had a drying residue of 97.77% (Mettler IR dryer HR 73 P, 120° C., standard drying, to constant weight). No caking in the dryer was observed. The dustless product obtained has a particle size of 1 μm to 300 μm and is very rapid to dissolve in water without clumping. A solution of 5 g of powder in 50 ml of water has a pH of 3.55.

Example AG 5

(7.1% Of Comp. c), based on HDI)

To a solution formed from 95.5 g of sorbitan polyethylene glycol (20) monododecanoate (e.g. Eumulgin SML 20 (Cognis) or Tween 20 (Croda)), alkoxylated with altogether 20 ethylene oxide units per sorbitan unit (HLB 16.7), in 3199.5 g of water and 4524.8 g of sodium bisulphite solution ($NaHSO_3$, 38-40% in water) are added at 25° C. and a pH of 4.36 1358.3 g of hexamethylene diisocyanate under agitation for 40 minutes. The temperature of the reaction mixture is then adjusted to 50° C. The pH is 5.62. Then, 70.3 g of citric acid (anhydrous) dissolved in 70.3 g of water are added.

This is followed by stirring at 50° C. for 1 hour during which the reaction mixture turns clear. This is followed by cooling down to 25° C. over 2 hours. This is followed by stirring at room temperature (20-23° C.) for 1 hour. The pH of the solution is 4.67. Then, 211.3 g of citric acid (anhydrous) dissolved in 211.3 g of water are added and stirred in for 15 minutes. The concentration is adjusted by adding 258.7 g of water to obtain a clear 35.0% strength solution having a pH of 3.11.

5000 g of a 35% solution of the above-described compound containing carbamoylsulphonate groups and 5000 g of tanning agent G7 are fed with the aid of a pump into a spray dryer with disc atomizer, the inlet temperature of which was set to 165° C. The exit temperature was between 70 and 80° C. No caking in the dryer was observed. This gave a white finely divided almost white powder having a bulk density of 562 g per 1000 ml, which had a drying residue of 99.27% (Mettler IR dryer HR 73 P, 120° C., standard drying, to constant weight). The dustless product obtained had a particle size of 5.0 μm to 300 μm and is very rapid to dissolve in water without clumping. A solution of 5 g of powder in 50 ml of water had a pH of 3.40.

Example AG 6

53.6 g of tanning agent G6 and 142.92 of the product of Example A18 are thoroughly ground in a mill to obtain a non-tacky mixture of pH 4.87. The product is dried to constant weight in a drying cabinet at 50 mbar and 20-40° C. to obtain 96.4 g of a white powder.

A solution of 5 g of this powder in 50 ml of water is cloudy/beige with a pH of 4.85.

Example AG 7

350 g of the solid compound containing carbamoylsulphonate groups (product from Example A8) and 500 g of a solid condensation product based on ditolyl ether sulphonic acid, 4,4'-dihydroxydiphenyl sulphone and formaldehyde (tanning agent G5) are intimately mixed in a mixing assembly and then ground to obtain a dustless product having a particle size of 2.0 μm to 22 μm.

The product is very rapid to dissolve in water without clumping. A solution of 5 g of powder in 50 ml of water had a pH of 3.40.

Examples AG 8 to AG 23

Example AG 6 is repeated by thoroughly grinding in each case 53.6 of tanning agent G 6 with in each case 142.9 g of the respective 35% strength aqueous solutions from Examples A 17 and also A19 to A33 in a mill. The mixtures obtained in each case are dried to constant weight in a drying cabinet at 50 mbar and 20-40° C. to obtain in each case white tanning agent powders AG 8 to AG 23.

Examples AG 24 to AG 38

Example AG 7 is repeated but, instead of the product of Example A8, in each case 350 g of the solid powder, containing carbamoylsulphonate groups, from any of Examples A1 to A7 and also Examples A9 to A 16 are intimately mixed with in each case 500 g of a solid condensation product based on ditolyl ether sulphonic acid, 4,4'-dihydroxydiphenylsulphone and formaldehyde (tanning agent G5) in a mixing assembly and then ground to obtain in each case homogeneous pulverulent products AG 24 to AG 38 having a particle size of 2.0 μm to 220 μm.

Examples AG 39 to AG 55

Example AG 5 was repeated by in each case equal parts of tanning agent G7 (i.e. of a 50% strength aqueous solution of tanning agent G5) and in each case one of the solutions containing carbamoylsulphonate groups from Examples A 17 to A33 being mixed and spray dried to obtain again low-dusting, readily water-soluble powders AG 39 to AG 55 having a particle size of 1 to 250 μm and a residual moisture content below 2.5%.

B) Use Examples

Tanning

The quantities of the particular products used (e.g. commercial products as supplied) are based on the weight of the raw material used or of the intermediate products.

B 1: Medical Sheepskin, Chromium-Free

In a paddle customary in the industry, air-dried sheepskins are wetted back with 20 l of water per skin and 2.0 g/l of a nonionic emulsifier based on a fatty alcohol ethoxylate at 25° C. overnight and subsequently fleshed. The skins thus prepared are degreased twice at 35° C. in aqueous float with 2.0 g/l of a nonionic emulsifier based on a fatty alcohol ethoxylate for 60 min each time and, after the float has been dropped, thoroughly rinsed with warm water.

To prepare for tannage, new float is initially charged and without pickling admixed at 25° C. with 5.3 g/l of inventive product from Example AG 1. Magnesium oxide is added in three doses to raise the pH to 8.8 in steps and then the temperature is raised to 40° C.

Following a run time of 12 h, 7 g/l of sulphated synthetic fatliquoring agent and 2.0 g/l of lecithin-based dispersing assistant are introduced into the same bath. After 2 h, the pH is reduced to 5.5 with formic acid. After the float has been dropped, the skins are thoroughly washed with cold water and finalized in a commercially customary manner, and have a shrinkage temperature of 77° C.

Compared with skins tanned with glutaraldehyde in the commercially customary manner, the inventive skins have a distinctly lighter colour not only for the leather but also for the wool, and better lightfastness. In the DIN 53315 A aldehyde test, the measured values are distinctly reduced compared with the prior art and are below the method's detection limit of 20 ppm.

Likewise good results were also obtained with the powders from Examples AG2 to AG7.

B 2: Production of Wet White for Full-Grained Upholstery Leather

Salted cattle hides are washed, limed, unhaired, fleshed and split in the commercially customary manner. The pelt material (2.7 mm) is washed with 200% of water and the float is dropped. For deliming, the pelts are agitated in 30% of fresh water with 0.4% of sodium bisulphite and 1.4% of an N-free deliming agent (Decaltal® A-N, product from BASF) for 10 minutes. Then, 0.15% of a degreasing agent based on fatty alcohol ethoxylate is added followed by agitation at 25° C. for 1 h (pH 8.4). Then, 50% of water and 1% of a bating enzyme (Novobate 1547, product from Novozyme) are added followed by agitation for 1 hour. The float is then dropped and the pelt washed again.

In 50% of fresh float, the pelt is conditioned for 1 hour with 0.25% of magnesium oxide at pH 9.5 and admixed with 6% of the inventive product from Example AG1 (as powder or diluted 1:1 with water), resulting in a pH of 8.3. After 3 hours, 0.3% of magnesium oxide is added to raise the float pH to 9.0-9.5 and the shrinkage temperature is measured. Following a run time of 1 hour, 0.2% of magnesium oxide and 0.1% of an aqueous ammonia solution (diluted 1:5 with water) are added (the pH is 9.1 after 1 hour) and the drum is agitated at 35° C. overnight (pH 9.2).

To prepare for retanning, the pH is reduced to 5.3 with 0.6% of formic acid (diluted 1:5 with water) in 3 portions. The float is dropped after 90 minutes. The wet white leathers (chromiumiessly tanned leather intermediate for mechanical treatment and further (re)tanning) are washed and summed. The shrinkage temperature is again measured (77° C.) and the leather is shaved down to 1.0 mm.

With regard to properties, a leather having a shrinkage temperature of 77° C., a smooth in appearance, a dry, firm handle and also a very good sammability and shavability was obtained.

Likewise good results were also obtained with the powders from Examples AG2 to AG55. The shrinkage temperature was in each case above 70° C., the in appearance was smooth in each case, the leathers have a dry, firm handle and a good to very good sammability and shavability.

B 3: Production of Wet White for Full-Grained Upholstery Leather

Salted cattle hides are washed, limed, unhaired, fleshed and split in the commercially customary manner. The pelt material (2.7 mm) is washed with 200% of water and the float is dropped. For deliming, the pelts are agitated in 30% of fresh water with 0.4% of sodium bisulphite and 1.4% of an N-free deliming agent (Decaltal A-N, product from BASF) for 10 minutes. Then, 0.15% of a degreasing agent based on fatty alcohol ethoxylate is added followed by agitation at 25° C. for 1 h (pH 8.4). Then, 50% of water and 1% of a bating enzyme (Novobate® 1547, product from Novozyme) are added followed by agitation for 1 hour. The float is then dropped and the pelt washed again.

In 50% of fresh float, the pelt is conditioned for 1 hour with 0.25% of magnesium oxide at pH 9.5 and admixed with 6% of the inventive product from Example AG1 (as powder or diluted 1:1 with water), resulting in a pH of 8.7. After 1 hour penetration time, 2.0% of a 4,4'-dihydroxydiphenyl sulphone/naphthalenesulphonic acid/formaldehyde condensate (e.g. TANIGAN® BN. product from LANXESS) and 1% of the formaldehyde condensate of aromatic sulphonic acids (e.g. TANIGAN® PR, product from Lanxess) are added. After a further 2 hours (pH 7.8), 0.2% of magnesium oxide and 0.1% of an aqueous ammonia solution (diluted 1:5 with water) are added (the pH is 9.0 after 1 hour) and the shrinkage temperature is measured. The drum is agitated at 35° C. overnight (pH 8.9).

To prepare for retanning, the pH is reduced to 5.3 with 0.6% of formic acid (diluted 1:5 with water) in 3 portions. The float is dropped after 90 minutes. The wet white leathers are washed and sammed. The shrinkage temperature is again measured (76° C.) and the leather is shaved down to 1.0 mm.

Likewise good results were also obtained with the powders from Examples AG2 to AG55.

B 4: Production of Wet White for an Upholstery Leather:

Salted cattle hides are washed, limed, unhaired, fleshed and split in the commercially customary manner. The pelt material (2.7 mm) is washed with 200% of water and the float is dropped. For deliming, the pelts are agitated in 30% of fresh water with 0.4% of sodium bisulphite and 1.5% of an N-free deliming agent (Decaltal® A-N, product from BASF) for 10 minutes. Then, 0.15% of a degreasing agent based on fatty alcohol ethoxylate is added followed by agitation at 25° C. for 90 minutes (pH 8.5). Then, 50% of water and 1% of a bating enzyme (Novobate® 1547, product from Novozyme) are added followed by agitation for 45 minutes. The float is then dropped and the pelt washed again.

In 50% of float, the prepared pelt is conditioned with 1% of sodium acetate and 1% of sodium carbonate at pH 9.9 and then admixed with 6% of the inventive product from Example AG1 (as powder or diluted 1:1 with water), resulting in a pH of 8.6. After 30 minutes' penetration time, 4% of a 4,4'-dihydroxydiphenyl sulphone/naphthalenesulphonic acid/formaldehyde condensate (e.g. TANIGAN® BN, product from LANXESS) and 2% of a formaldehyde condensate of aromatic sulphonic acids (e.g. TANIGAN® PR, product from Lanxess) are added (addition as 50% solutions, pH 7). After 1 hour (pH 8.2) portionwise addition of altogether 1% of sodium carbonate (diluted 1:10 with water) is used to raise the float pH to 8.7 over 2 hours, and the shrinkage temperature is measured. The leather is subsequently agitated at 30° C. overnight (pH 8.1).

To prepare for retanning, the pH is reduced to 7.2 with 0.6% of formic acid (diluted 1:10 with water) in 3 portions, the float is dropped and the wet white leather is summed. The shrinkage temperature is measured (70° C.) and the leather is shaved down to 1.0 mm.

Likewise good results were also obtained with the powders from Examples AG2 to AG55.

B 5: Production of Wet White for Shoe Upper Leather

Salted cattle hides are washed, limed, unhaired, fleshed and split in the commercially customary manner. The pelt material (2.6 mm) is washed with 200% of float and the float is dropped. For deliming, the pelts are agitated in the drum in 100% of float and 0.3% of sodium bisulphite, 1.0% of an N-free deliming agent (e.g. Decaltal® ES-N, product from BASF) and also 0.3% of a mixture of dicarboxylic acids (e.g. Bascal® S, product from BASF) for 1 hour at 25° C. At pH 7.7, 1% of a bating enzyme (Novobate 1547, product from Novozyme) and 0.1% of a degreasing agent based on fatty alcohol ethoxylate are added followed by agitation for a further 45 minutes and the float is then dropped and the pelt washed twice.

The prepared pelt is conditioned for 1 hour with 1% of sodium acetate at pH 8.0 and admixed with 1.7% of the inventive product from Example AG1 (as powder or diluted 1:1 with water). After 20 minutes' penetration time, 0.2% of sodium carbonate (diluted 1:10 with water) is added followed by 30 minutes of agitation. Then, a further 3.4% of the inventive product from Example AG1 (as powder or diluted 1:1 with water) are added. After 1.5 hours, portionwise addition of altogether 0.4% of sodium carbonate (diluted 1:10 with water) is used to raise the pH to 8.2 over 2 hours, and the shrinkage temperature is measured. Then, the drum is agitated overnight at 35° C. Then, the pH is reduced to 7.0 with formic acid (diluted 1:10 with water). This is followed by agitation of the drum for 2 hours. The float is then dropped. The wet white leathers are washed and sammed. The shrinkage temperature is remeasured (72° C.). The leathers can be processed without problems and are shaved to a thickness of 1.2 mm.

Likewise good results were also obtained with the powders from Examples AG2 to AG55.

B 6: Automotive Upholstery Leather Tanned without Chromium:

The shaved wet white leathers from Example B 4 are agitated with 300% of water (35° C.) and 0.2% of a fatty alcohol ethoxylate at pH 7.6 for 20 minutes. After the float has been dropped, 50% of water, 3% of a naphthalenesulphonic acid/formaldehyde condensate (TANIGAN® RFS, product from LANXESS), 1.5% of sodium formate and, for preliminary fatliquoring, 3% of a lecithin-based fatliquoring agent (BAYKANOL® Licker SL, product from Lanxess) (diluted 1:8 with water) are added. Following a run time of 30 minutes, 2% of a polyacrylate dispersion (LEUKOTAN® 1084, product from Dow/Lanxess) (diluted 1:3 with water) and after a further 10 minutes 3% of a modified polyamide carboxylic acid (LEVOTAN® L, product from Lanxess) (diluted 1:3 with water) are added as filling and softening retanning agents. After a further 10 minutes of run time, 8% of tara and 5% of a synthetic tanning agent based on a 4,4'-dihydroxydiphenyl sulphone/naphthalenesulphonic acid/formaldehyde condensate (TANIGAN® BN, product from LANXESS) and after 30 minutes (pH 5.5) additionally 8% of mimosa and a further 5% of a synthetic tanning agent based on a 4,4'-dihydroxydiphenyl sulphone/naphthalenesulphonic acid/formaldehyde condensate (TANIGAN® BN, product from LANXESS) are added. This is followed by dyeing for 2 hours with 3% of dye (pH 5.5-5.8). After refloating with 50% of water, a further 4% of a lecithin-based fatliquoring agent (BAYKANOL® Licker SL, product from Lanxess) (diluted 1:8 with water) are added followed by tumbling at 50° C. for 1 hour. Then, 2% of formic acid (diluted 1:5 with water) is added in 2 portions for 45 minutes for fixing (pH 4) and the float is dropped. The leather is washed with 200% of water (50° C.).

A fresh float (100% of water, 50° C.) incorporating 4% of a lecithin-based fatliquoring agent (BAYKANOL® Licker SL, product from Lanxess) (diluted 1:8 with water) is used to perform the top fatliquoring in the course of a run time of 1 hour. The leather is then acidified with 1% of formic acid (diluted 1:5 with water) to pH 3.4 in 2 steps followed by fixing for 45 minutes. The float is then dropped, the leather is washed twice with 200% of water and finalized in a commercially customary manner by setting out, vacuum drying (50° C.), suspension drying, staking, milling, staking.

This gives very soft and yet tight-grained, level-dyed crust leathers having a very uniform milled grain, which are finishable with excellent results.

B 7: Shoe Upper Leather Tanned without Chromium:

The shaved wet white leathers from Example B 5 are washed at 35° C. in 150% float with 0.3% of formic acid (diluted 1:10 with water) for 20 min (pH 4.3) and the float is dropped.

A fresh float (100% of water 30° C.) is used to subject the leathers to a preliminary fatliquoring with a mixture of 2% of a synthetic fatliquoring agent and 1% of a lecithin-based fatliquoring agent (diluted 1:8 with water) and 5% of a 4,4'-dihydroxydiphenyl sulphone-based tanning agent (TANIGAN® 3LN, product from Lanxess). After 20 minutes, 10% of a dihydroxydiphenyl sulphone/naphthalenesulphonic acid/formaldehyde condensate (TANIGAN® CF liquid, product from LANXESS) (diluted 1:1 with water) are added in 2 portions and drummed in for 45 minutes (pH 4.5). Then, 70% of water and 2% of a dispersant based on aromatic sulphonic acids (TANIGAN® PAK, product from Lanxess) are added. Following a run time of 15 minutes, initially 4% of a modified polyamide carboxylic acid (LEVOTAN LB, product from Lanxess) (diluted 1:3 with water) and 3% of a polyacrylate dispersion (LEUKOTAN® 8090, product from Dow/Lanxess) are added. After a further 20 minutes, a mixture of 3% of a synthetic fatliquoring agent and 2% of a lecithin-based fatliquoring agent (BAYICANOL® Licker FSU and SL, products from Lanxess) (diluted 1:5 with water) is added followed after a further 15 minutes by a mixture of 5% of mimosa and 12% of synthetic tanning agents based on 4,4'-dihydroxydiphenyl sulphone/formaldehyde condensates (TANIGAN® VR, TANIGAN® 3LN, products from LANXESS). Following a run time of 30 minutes, the leathers are sweetened with 12% of a mixture of chestnut and fully tanned and dyed with synthetic tanning agents based on a dihydroxydiphenyl sulphone/naphthalenesulphonic acid/formaldehyde condensate (TANIGAN VR, product from LANXESS) and a resin tanning agent (RETINGAN® ZF Plus, product from Lanxess) in the presence of 1% of dye and 2% of a dyeing auxiliary (BAYKANOL® TF-2N, product from Lanxess).

The next morning, following addition of 100% of water (50° C.), a top fatliquoring is performed with a mixture of 3% of a lecithin-based fatliquoring agent, 3% of a lanolin-based fatliquoring agent (BAYKANOL® Licker LA, product from Lanxess), 2% of a synthetic fatliquoring agent (BAYKANOL® Licker SL, FSU, products from Lanxess) and also 1% of neatsfoot oil (e.g. Atlas Neatsfoot® Oil 30 CT) (diluted 1:5 with water). Following a run time of 60 minutes, the levels are fixed with 3% of formic acid (diluted 1:10 with water) in 3 portions in the course of 80 minutes (pH 3.6) and the float is dropped. The leathers are washed and finalized in a commercially customary manner.

This gives very soft and yet tight-grained, level-dyed crust leathers having a very uniform milled grain, which are finishable with excellent results.

What is claimed is:

1. A pre-mix tanning material for producing a tanning agent product, the tanning material comprising a mixture of:

a) 10 to 99 wt% of at least one compound containing carbamoylsulphonate groups, wherein the at least one compound comprises reaction products formed from a reaction between organic polyisocyanates and bisulphite or disulphite, and the organic polyisocyanate is a polyisocyanate having an NCO functionality of 1.8 to 2.5 and a molecular weight is less than 400 g/mol; and b) 1 to 90 wt% of at least one organic tanning agent selected from the group consisting of syntans, resin tanning agents, polymeric retanning agents, and vegetable tanning agents, wherein the pre-mix tanning material is a spray-dried, solid, particulate material.

2. The tanning material according to claim 1, wherein the tanning material is a powder having a residual moisture content of 0 to 10 wt%, based on the weight of the material, and an average particle size of 0.1 to 1000 μm.

3. The tanning material according to claim 1, wherein:

the organic polyisocyanate has NCO groups attached to aliphatics or cycloaliphatics; and the at least one organic tanning agent comprises at least one condensation product based on A) sulphonated aromatics, or B) aldehydes or ketones, or optionally C) one or more compounds selected from the group of aromatics which are not sulphonated, urea and urea derivatives.

4. The tanning material according to claim 3, wherein the NCO groups are attached to groups selected from 1,4-diioscyanatobutane, 1,6-diisocyanato-hexane (HDI), 1,5-diisocyanato-2.2-dimethylpentane, 2.2,4- or 2,4,4-trimethyl-1,6-diisocyanatohexane (TMHI), 1,3- and 1,4-diisocyanatohexane, 1,3- and 1,4-diisocyanatocyclohexane (CHDI) and also any desired mixtures of these isomers, 1-isocyanato-2-isocyanatomethylcyclopentane, 1,2-, 1,3- and 1,4-bis(isocyanatomethyl)cyclohexane and also any desired mixtures of isomers, 1,2-, 1,3-and 1,4-bis(isocyanatoethyl)cyclohexane and also any desired mixtures of these isomers, 1,2-, 1,3- and 1 ,4-bis(isocyanato-n-propyl)cyclohexane and also any desired mixtures of these isomers, 1-isocyanatopropyl-4-isocyanatomethylcyclohexane and isomers, 1-isocyanato-3,3,5-trimethyl-5-isocyanatomethylcyclohexane (IPDI), 1-isocyanato-1-methyl-4-isocyanatomethylcyclohexane (IMCI), 2,4'- and 4,4'-diisocyanatodicyclohexylmethane ($H_{12}MDI$) and isomers, dimeryl diisocyanate (DDI), bis(isocyanatomethyl)bicyclo[2.2.1]heptane (NBDI), bis(isocyanatomethyl)tricyclo[5.2.1.0$^{2,6}$]decane (TCDDI) and isomers, and any desired mixtures of such diisocyanates and xylylenediisocyanates of the formulae

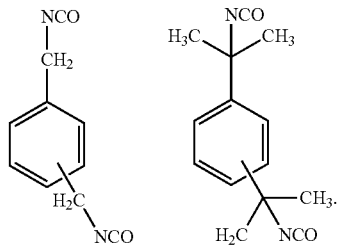

5. The tanning material according to claim 1, wherein the at least one organic tanning agent comprises at least one syntan.

6. The tanning material according to claim 5, wherein the at least one organic tanning agent comprises at least one condensation product selected from at least one condensation product obtained by condensation of sulphonated naphthalene and sulphonated phenol or 4, 4'-dihydroxydiphenyl sulphone with formaldehyde or by condensation of naphthalenesulphonic acid and formaldehyde or by condensation of sulphonated ditolyl ether, sulphonated phenol with formaldehyde or by condensation of sulphonated phenol, urea, phenol with formaldehyde or by condensation of sulphonated phenol, urea, phenol, sulphonated ditolyl ether with formaldehyde, or by condensation of sulphomethylated dihydroxydiphenyl sulphone / urea with aldehydes, and also by condensation of sulphomethylated dihydroxydiphenyl sulphone / phenol / urea or urea derivatives and aldehydes, or mixtures thereof.

7. The tanning material according to claim 1, further comprising at least one emulsifier component c) comprising at least one nonionic alkoxylated polyol containing ester groups and having an HLB value of at least 13 (c1) or an alkylglycoside (c2) and/or a nonionic alkoxylated alcohol free of ester groups (c3).

8. The tanning material according to claim 7, wherein:

the compound c1) is a reaction product of a polyol with at least one alkylene oxide of 2 to 6 carbon atoms, in an amount of 10 to 60 mol equivalents, based on the polyol, to produce a first reaction product, and subsequent reaction of the first reaction product with at least one carboxylic acid of 6 to 30 carbon atoms;

the compound c2) comprises alkylmonoglucosides, alkyldiglucosides, alkyltriglucosides, or higher homologues and mixtures thereof, and wherein hydroxyl groups of the c2) compound are partially substituted with $C_6$-$C_{18}$-alkyl groups; and the compound c3) comprises alkoxylates of aliphatic alcohols with a chain length of 5 to 30 carbon atoms and 1 to 25 alkoxy units.

9. The tanning material according to claim 8, wherein the polyol is a polyol selected from the group consisting of glycerol, trimethylolpropane, pentaerythritol, dipentaerythritol, polyols derived from mono- and polysaccharides, sorbitol, and polyols with sorbitan core scaffold.

10. The tanning material according to claim 1, wherein the at least one organic tanning agent comprises at least one resin tanning agent.

11. The tanning material according to claim 1, wherein the at least one organic tanning agent comprises at least one polymeric retanning agent.

12. The tanning material according to claim 1, wherein the at least one organic tanning agent comprises at least one tanning agent obtained from vegetable sources.

13. The tanning material according to claim 1, wherein the material further comprises at least one of:

component d) at least one carboxylic acid selected from a group comprising oxalic acid, succinic acid, glutaric acid, adipic acid, hydroxy-polycarboxylic acid, citric acid, tartaric acid, lactic acid and mixtures thereof; and at least one additional substance e) selected from the groups of fatliquoring agents, fillers and buffer substances.

14. The tanning material according to claim 1, wherein the material comprises:

10 to 99 wt% of component a),
1 to 90 wt% of component b),
0 to 5 wt% of at least one emulsifier,
0 to 15 wt% of at least one carboxylic acid,
0 to 15 wt% of at least one additional substance selected from the groups of fatliquoring agents, fillers and buffer substances, and
0 to 5 wt% of water, and
the solid particulate material has an average particle size of 1 to 800 μm.

15. The tanning material according to claim 1, wherein each of the at least one compound containing carbamoylsulphonate groups and the at least one organic tanning agent are solid, particulate materials, and the tanning material is a dry powder with a residual moisture content of 0 to 5 wt%.

16. The tanning material according to claim 1, wherein the material comprises:

30 to 80 wt% of component a),
18.99 to 70 wt% of component b),
0.01 to 3 wt% of at least one emulsifier,
1 to 10 wt% of at least one carboxylic acid,
0 to 10 wt% of at least one additional substance selected from the groups of fatliquoring agents, fillers and buffer substances, and
0 to 2 wt% of water, and
the solid particulate material has an average particle size of 50 to 300 μm.

17. The tanning material according to claim 1, wherein the material comprises:

30 to 70 wt% of component a), and
30 to 70 wt% of component b); and
has a residual moisture content of 0 to 1 wt%.

* * * * *